US007290484B1

(12) United States Patent
Kirar et al.

(10) Patent No.: US 7,290,484 B1
(45) Date of Patent: Nov. 6, 2007

(54) STRAPPING MACHINE

(75) Inventors: Matt E. Kirar, Trevor, WI (US); Allan J. Bobren, Streamwood, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 11/672,316

(22) Filed: Feb. 7, 2007

Related U.S. Application Data

(62) Division of application No. 11/381,411, filed on May 3, 2006, now Pat. No. 7,240,612.

(51) Int. Cl.
*B65B 13/04* (2006.01)
*B65B 13/20* (2006.01)
*B65B 13/32* (2006.01)

(52) U.S. Cl. ..... 100/7; 100/3; 100/26; 100/29; 53/589

(58) Field of Classification Search ..... 100/3, 100/7, 14, 18, 26, 29, 32; 53/589, 590; 198/345.1, 198/416; 414/788, 907
See application file for complete search history.

(56) References Cited

U.S. PATENT DOCUMENTS 3,511,173 A * 5/1970 Morrow ..... 100/7
5,415,087 A * 5/1995 Sniffen et al. ..... 100/4
5,944,477 A * 8/1999 Shill ..... 414/788
6,789,469 B1 * 9/2004 Tipton et al. ..... 100/4

* cited by examiner

*Primary Examiner*—Jimmy T. Nguyen
(74) *Attorney, Agent, or Firm*—Mark W. Croll; Donald J. Breh; Levenfeld Pearlstein, LLC

(57) ABSTRACT

A strapping machine feeds strapping material around a load, positions, tensions and seals the material around the load. The machine includes a work surface, a portion of which is upwardly pivotal. A conveyor mounted within the work surface has a friction belt drive. The conveyor roller closest to the strap chute has a middle portion that has a smaller diameter than the end portions. The middle portions are fitted together to rotate as a unitary element. A load compression assembly is mounted at the strap chute. A side squaring assembly aligns the load in the direction transverse to the load direction. A strap guide extends between a pre-feed assembly and the feed assembly and includes a fixed portion and a movable portion forming a guide path that is opened to access the guide path. An interlocked enclosure is mounted to the machine frame below the work surface to access the sealing head and the feed assembly.

5 Claims, 40 Drawing Sheets

STRAPPING MACHINE

CROSS-REFERENCES TO RELATED APPLICATIONS

This application is a divisional application of U.S. patent application Ser. No. 11/381,411, filed May 3, 2006, now U.S. Pat. No. 7,240,612.

BACKGROUND OF THE INVENTION

The present invention is directed to an improved strapping machine. More particularly, the present invention is directed to a strapping machine having an improvements in conveyance and handling of loads in the machine and access to internal systems for maintenance.

Strapping machines are in widespread use for securing straps around loads. One type of known strapper includes a strapping head and drive mechanism mounted within a frame. A chute is mounted to the frame, through which the strapping material is fed.

In a typical stationary strapper, the chute is mounted at about a work surface, and the strapping head is mounted to a horizontal portion of the chute, below the work surface. The drive mechanism is also mounted below the work surface, near to the strapping head. The drive mechanism "pulls" or feeds strap material from a source, such as dispenser into the machine. The drive mechanism urges or feeds the strap through the strapping head, into and around the chute, until the strap material returns to the strapping head. The drive mechanism also retracts the strap material to tension the strap around the load.

It has also been found that it is often necessary to access the strapping head (and more specifically the weld head) by removing portions of the work surface. This may be necessary to dislodge misfed strap, to clear the strapping head or weld head, or for general maintenance or repair of the machine. Quite often, it is necessary to access the strap path (by moving the strap chute) at the weld head.

Often strapping machines are positioned or located in a product line such that the working surface of the strapper is at a higher elevation than a conventional work surface. In such instances, it can be difficult to open the various panels and the like to permit access to the internal portions of the machine. This is particularly the case with moving or removing the working surfaces of the strapper to access the strapping head and the feed/retraction mechanism.

Many such machines are employed in processes that maximize the use of fully automated operation. To this end, machines are configured for automated in-feed and out-feed, such that a load (to be strapped) is automatically fed into the machine by an in-feed conveyor, the strapping process is carried out, and the strapped load is automatically fed out of the machine by an out-feed conveyor. However, there may be times that loads are physically too small to be moved into the strapping area by known conveyors, or other times that loads come into the strapping area that are askew and require squaring or straightening, or may need to be compressed before being strapped.

Accordingly there is a need for an improved strapping machine that facilitates package or load handling and strapping. Desirably, such a machine facilitates the handling and strapping of loads that may otherwise be difficult to handle. More desirably, such a machine eases movement or removal of the work surfaces to access the internal portions of the machine.

BRIEF SUMMARY OF THE INVENTION

A strapping machine is configured to feed a strapping material around a load, position, tension and seal the strapping material around the load. The machine includes a work surface for supporting the load. At least a portion of the work surface is upwardly pivotal.

A conveyor is mounted within the work surface that has a friction belt drive. The conveyor includes a pair of end rollers that define a plane and the conveyor rollers are engaged by the belt along the plane. Intermediate rollers are disposed between the end rollers. A tension roller maintains tension in the belt. The conveyor is configured so that a load present on the conveyor increases a force between the conveyor rollers and the drive belt to drive the conveyor.

A strap chute carries the strapping material around the load and releases strap from the strap chute. A load compression assembly is mounted to the frame and disposed above the work surface. The compression assembly includes a reciprocating gate that moves toward the work surface to contact and compress the load prior to conveying the strap around the load. The gate is actuated by a rod-type cylinder operably connected to the machine frame and to an uppermost point on the gate. The cylinder and rod are below the uppermost point of the gate when the gate is in the feed or the compressed state. Preferably, the cylinder is enclosed within the arch enclosure of the chute. The gate can be formed from a transparent or translucent material to permit viewing the load through the gate.

The conveyor roller closest to the strap chute has end portions and a middle portion that has a smaller diameter than the end portions. The end and middle portions are fitted together to rotate as a unitary element. The roller includes a pair of spindles, one in each end portion extending toward the middle portion. The spindles are rotatable independent of their respective end portions and independent of one another.

The machine includes a side squaring assembly that aligns the load in the direction transverse to the load direction. The side squaring assembly includes a pair of side plates that substantially simultaneously move toward one another to square the load on the conveyor. The side squaring assembly includes a drive having a pair of substantially mirror image cylinders The side plates can each include a forward squaring plate mounted to the side plate transverse to the side plate. The forward squaring plate squares the load in the machine direction. The machine can also include a longitudinal squaring drive having a pair of rotating engaging elements for squaring the load in a longitudinal direction. Load contact elements are loosely mounted to the rotating engaging elements such that the load is driven forward by the contact elements when there is low resistance to movement and when the load resists movement the contact elements stop and the rotating engaging elements rotate freely of the stopped contact elements.

A strap guide extends between the pre-feed assembly and the feed assembly and includes a fixed portion and a movable portion. The movable portion moves toward and away from the fixed portion to form a guide path that is opened to access the guide path.

An enclosure is mounted to the machine frame below the work surface. The sealing head and the feed assembly are located within the enclosure and are accessed by an interlocked, openable access panel and an interlocked access door on the panel.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
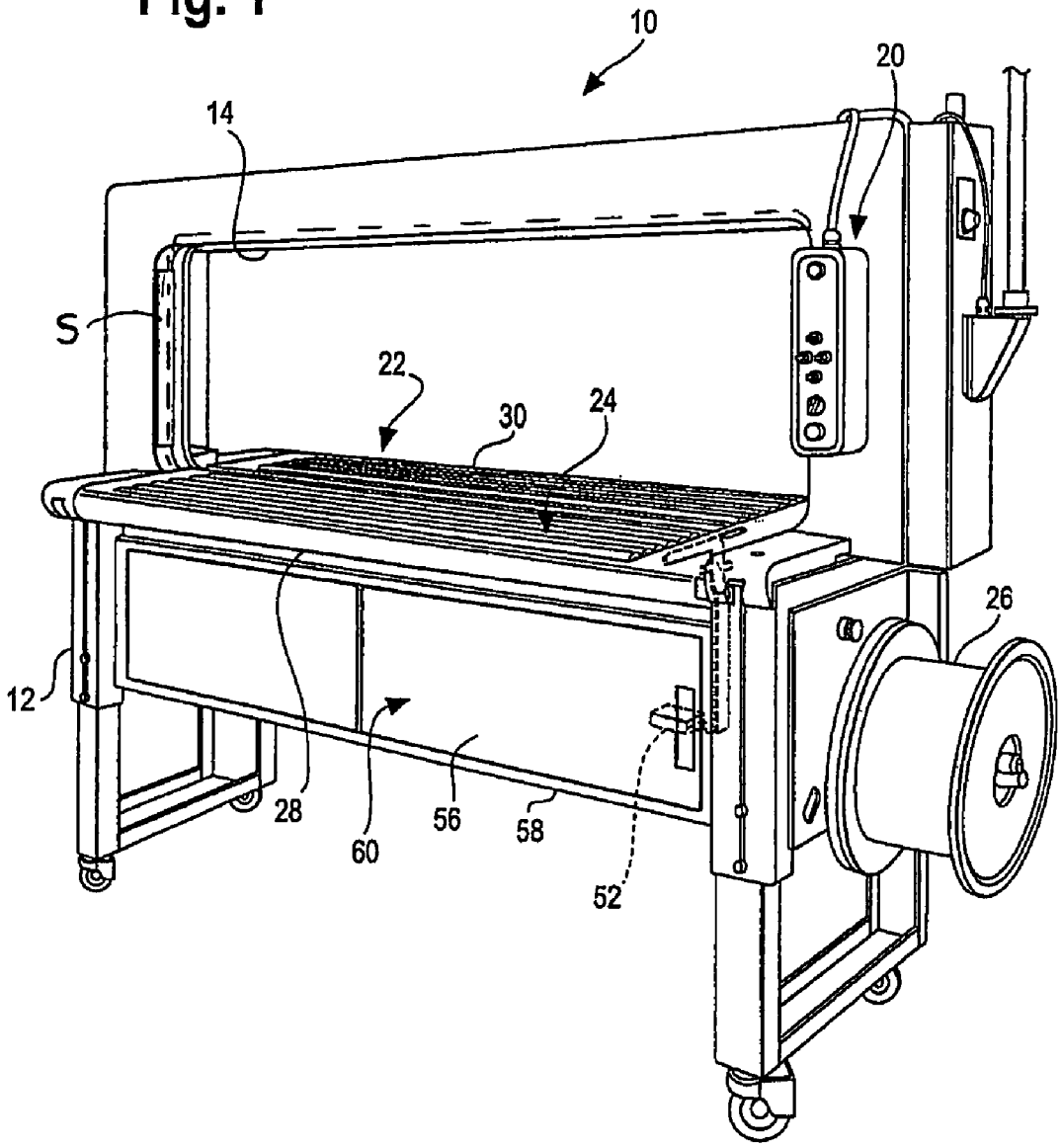
FIG. 1 is a perspective view of a strapping machine illustrating in phantom a work surface lift system of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 25:
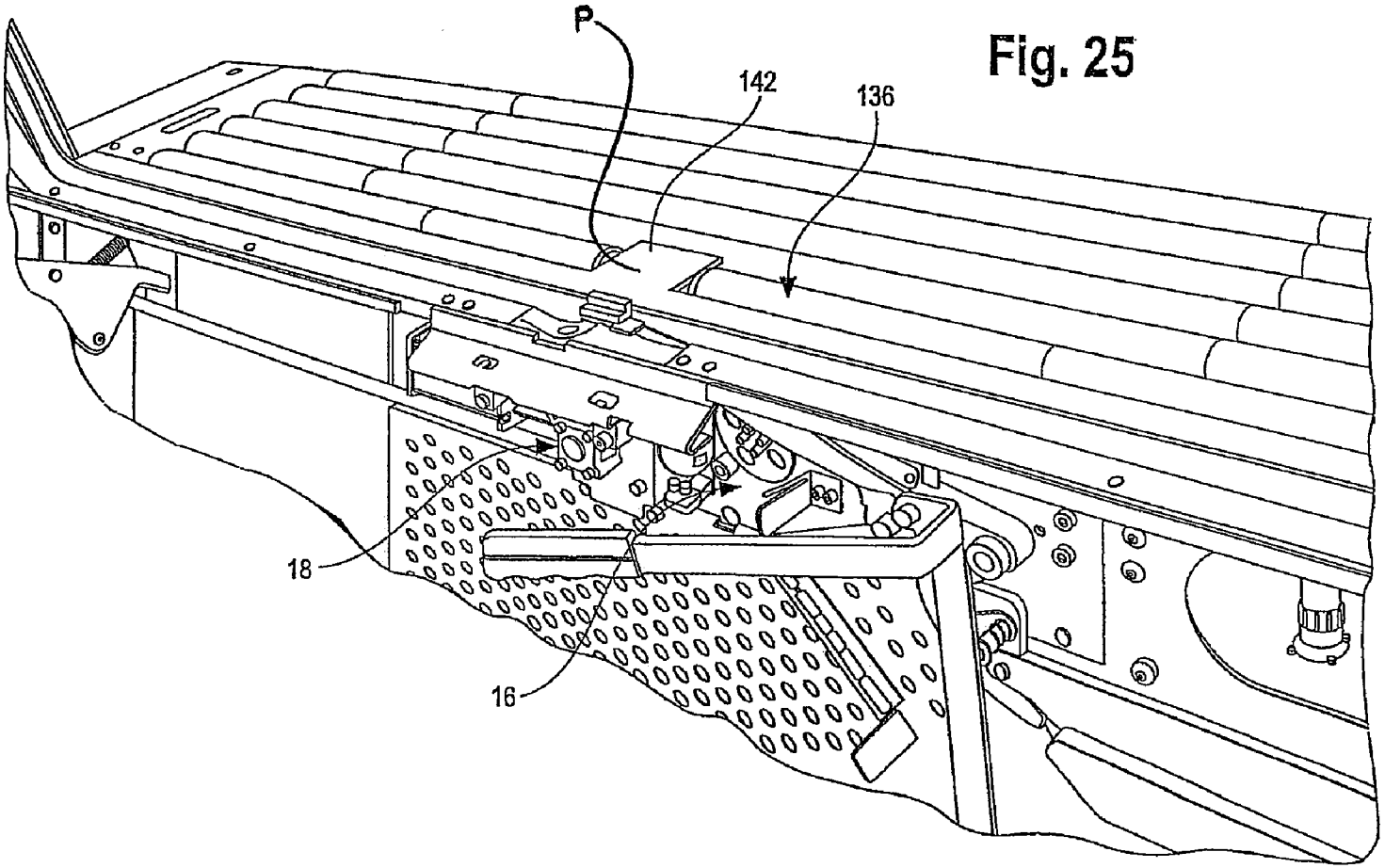
FIG. 25 is a perspective view of the nose roller positioned in the conveyor, adjacent to the area at the strapping head.
Figure 26:
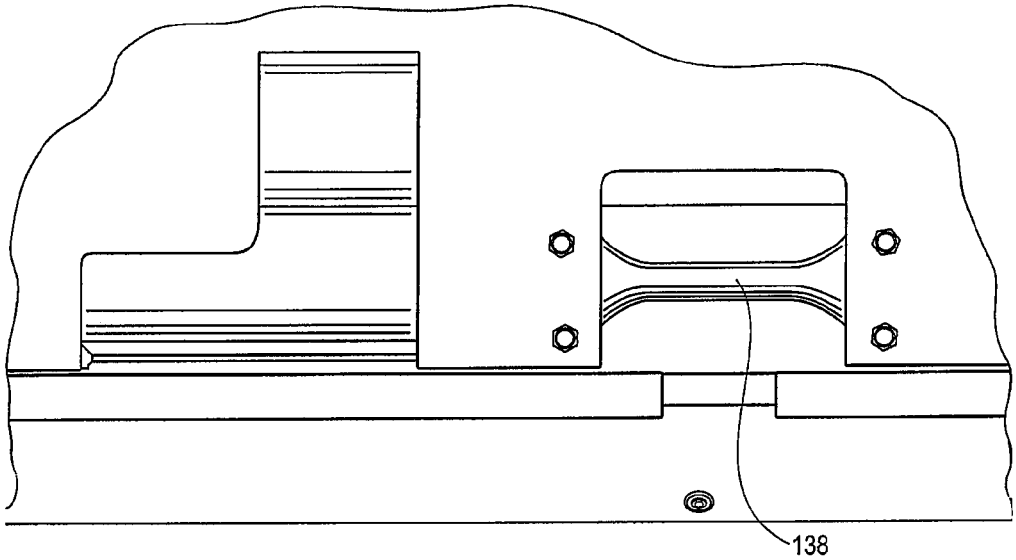
FIG. 26 is an enlarged partial view of the nose roller.
Figure 27:
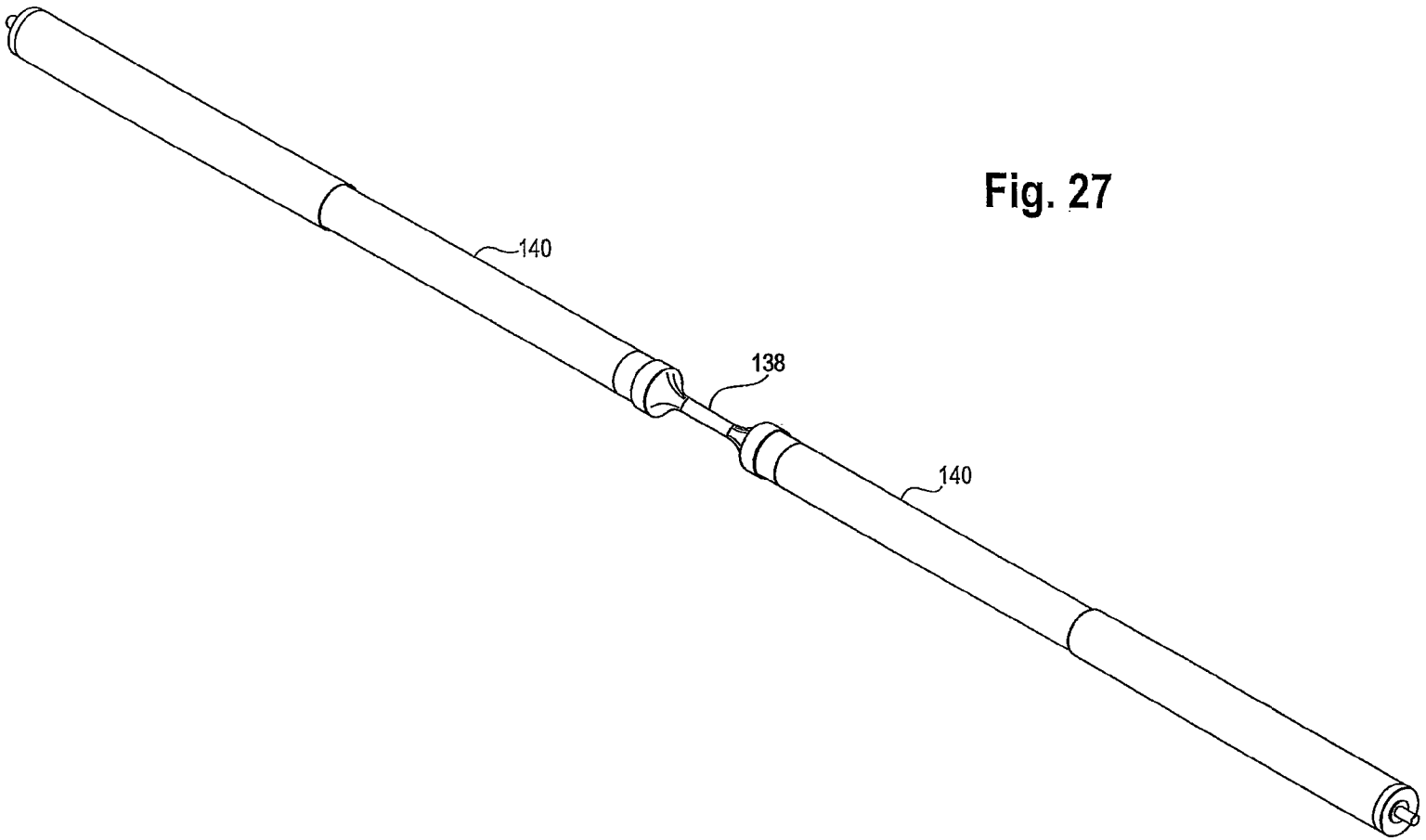
FIG. 27 is a perspective view of the nose roller removed from the conveyor system.
Figure 28:
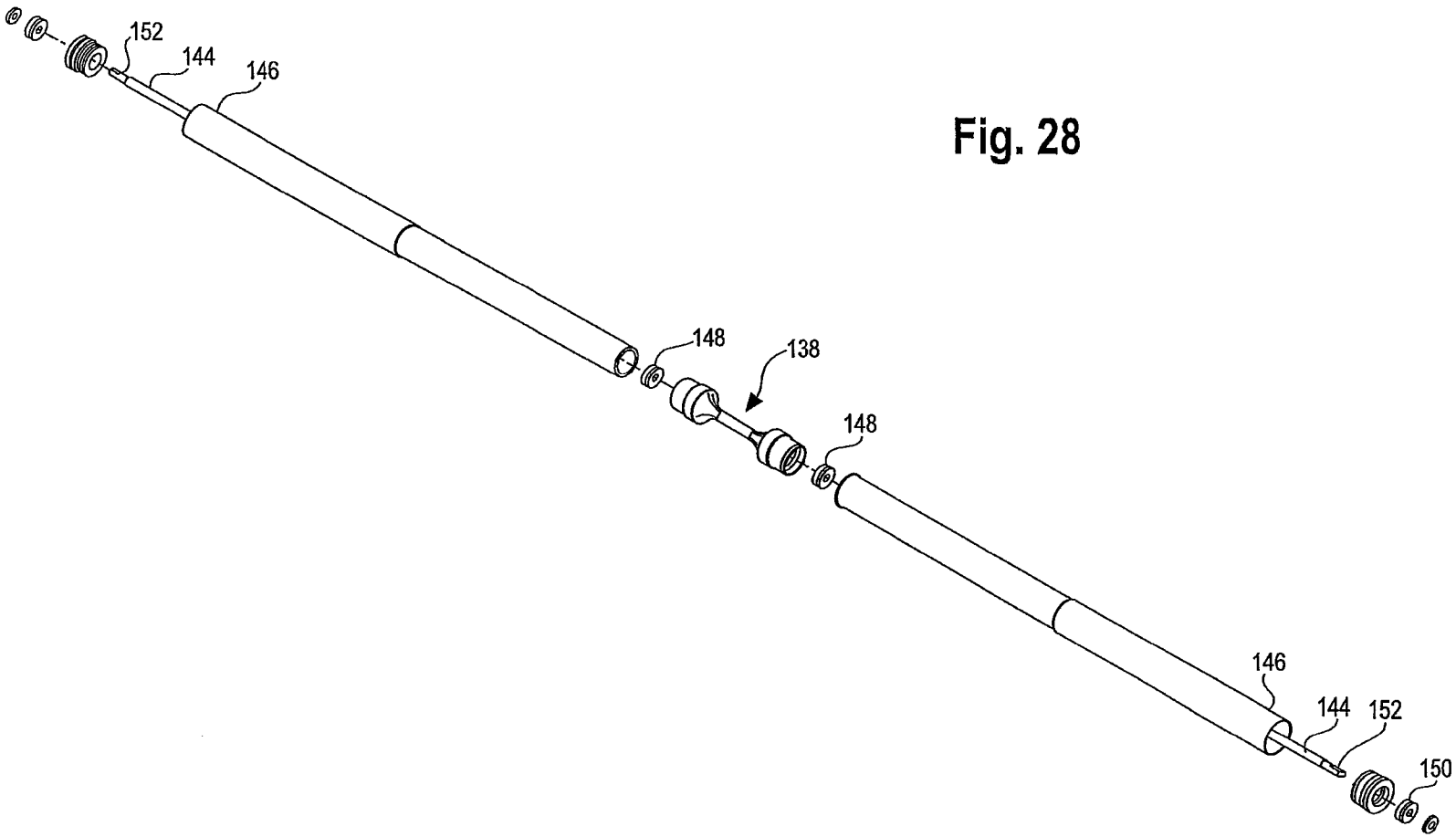
FIG. 28 is an exploded view of the nose roller.

Referring to the figures and in particular FIG. 1, there is shown generally a strapping machine 10 embodying the principles of the present invention. The strapping machine 10 includes, generally, a frame 12, a strap chute 14, a feed assembly 16 and a weld head 18 (both shown briefly in FIG. 25). A controller 20 provides automatic operation and control of the strapper 10. A table top or work surface 22 is disposed on the strapper 10 at the bottom of the chute 14. The work surface 22 is configured as a conveyor 24 and will be discussed in more detail herein. A strap supply or dispenser 26 supplies strapping material S to the feed assembly 16 and weld head 18.

The work surface 22, again as will be discussed below, is configured having in-feed and out-feed conveyors 28, 30 that are formed as part of the work surface 22 and pivot upwardly and outwardly (relative to the strap chute 14) to provide access to the internal components, e.g., the feed assembly 16 and the weld head 18. This is often necessary to conduct maintenance or inspection of these areas. It will also be appreciated that the work surface 22 is often at a height that is greater than a conventional work surface height. That is, the work surface 22 is positioned at a height that is complementary to the other aspects of whatever operation the strapper 10 is part of. As such, the work surface 22 could be at a height that makes it difficult to lift the conveyors 28, 30 to access the internal components.

Figure 2:
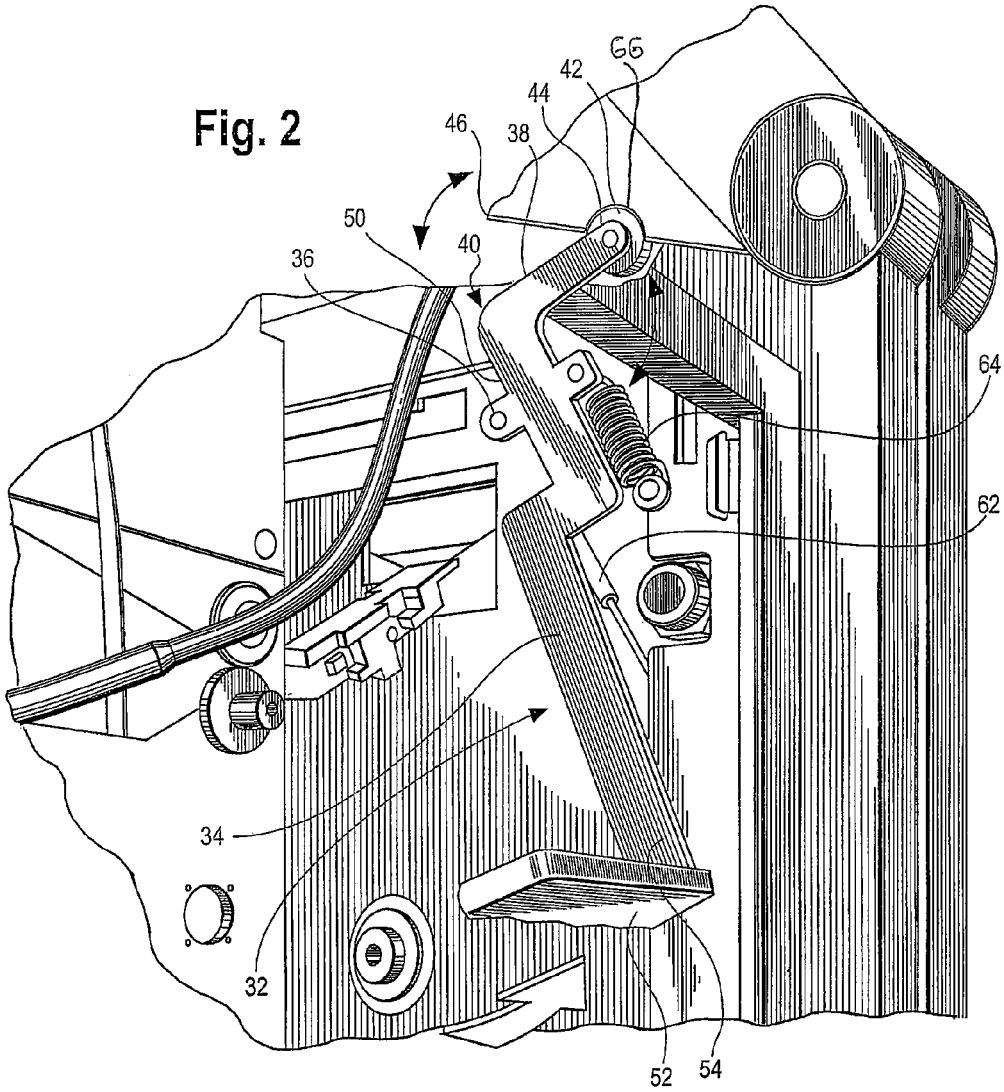
FIG. 2 is a partial perspective view of the underside of the work surface illustrating the lift lever and arm.
Figure 3:
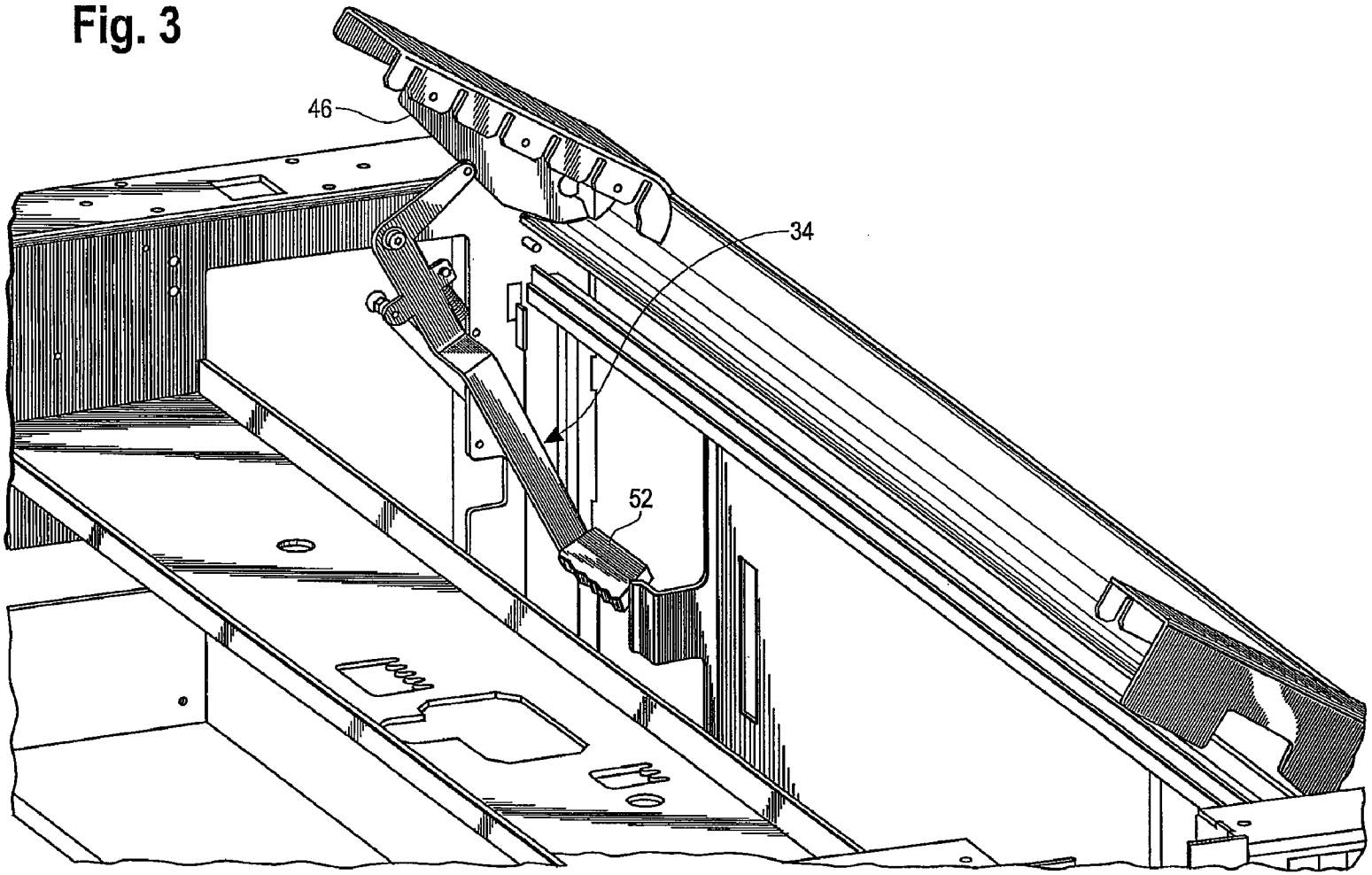
FIG. 3 is view of the lever and arm showing the arm engaging the work surface.
Figure 4:
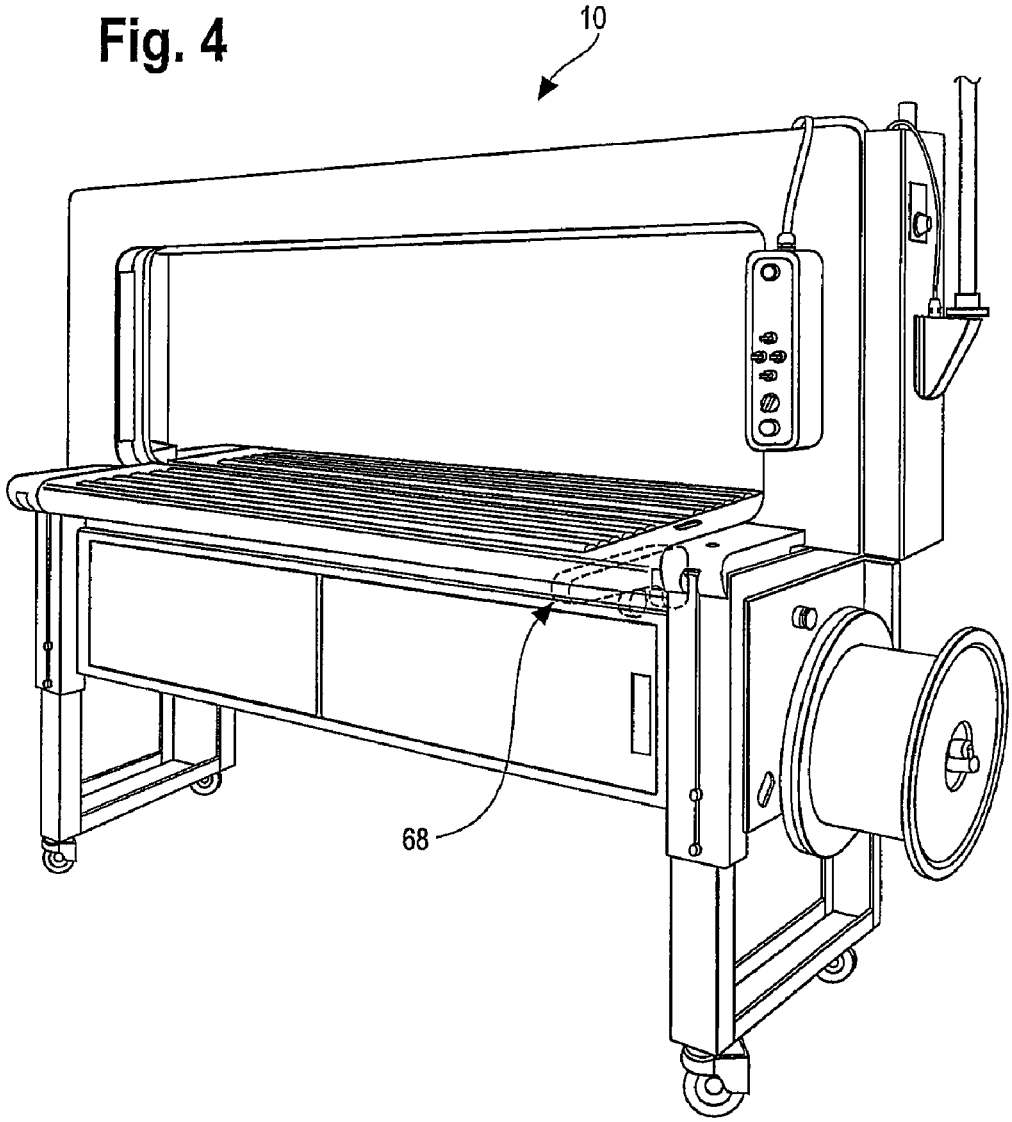
FIG. 4 is a perspective view of the strapping machine illustrating in phantom a load weight engaging conveyor system of the present invention.
Figure 5:
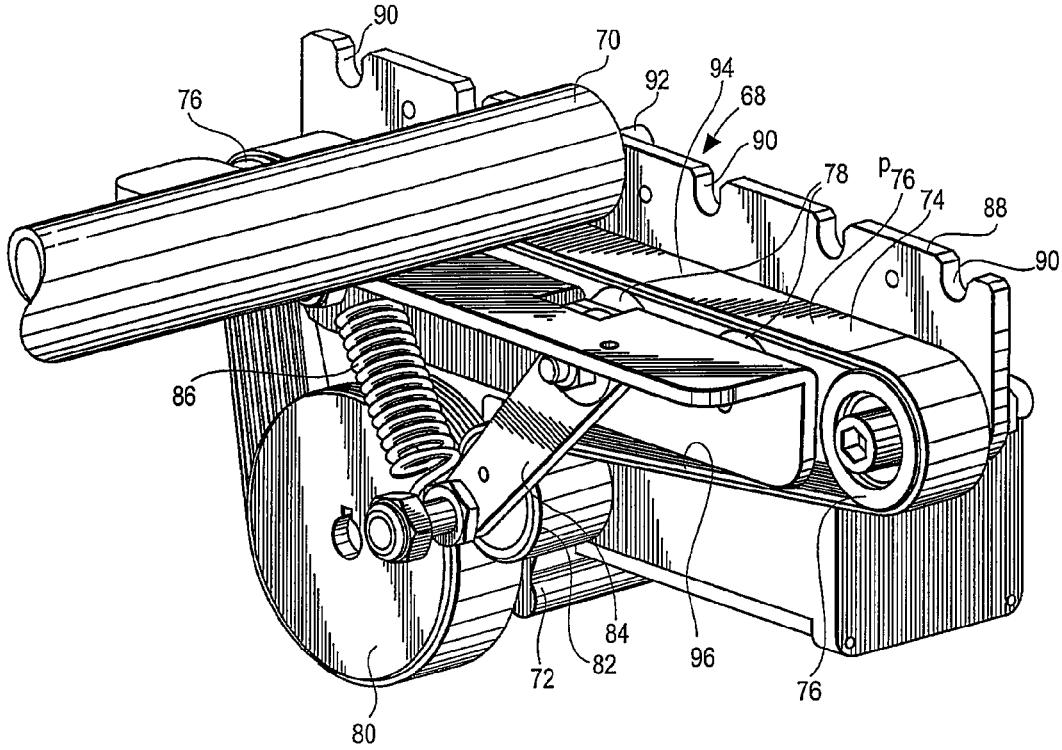
FIG. 5 is an enlarged, partial perspective view of the weight engaging conveyor system with a single roller in place.
Figure 6:
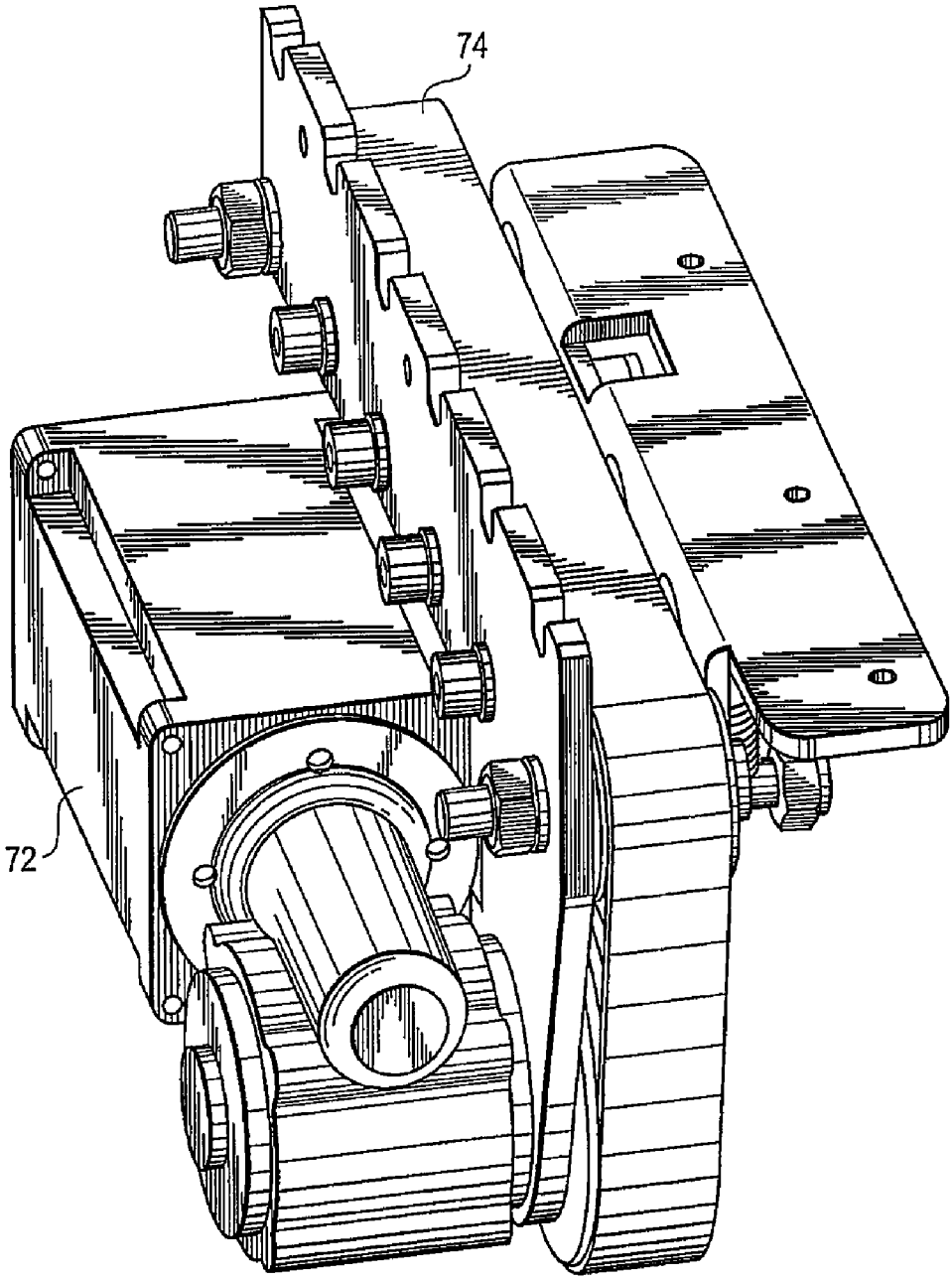
FIG. 6 is a top perspective view of the conveyor system with the rollers removed for ease of illustration.
Figure 7:
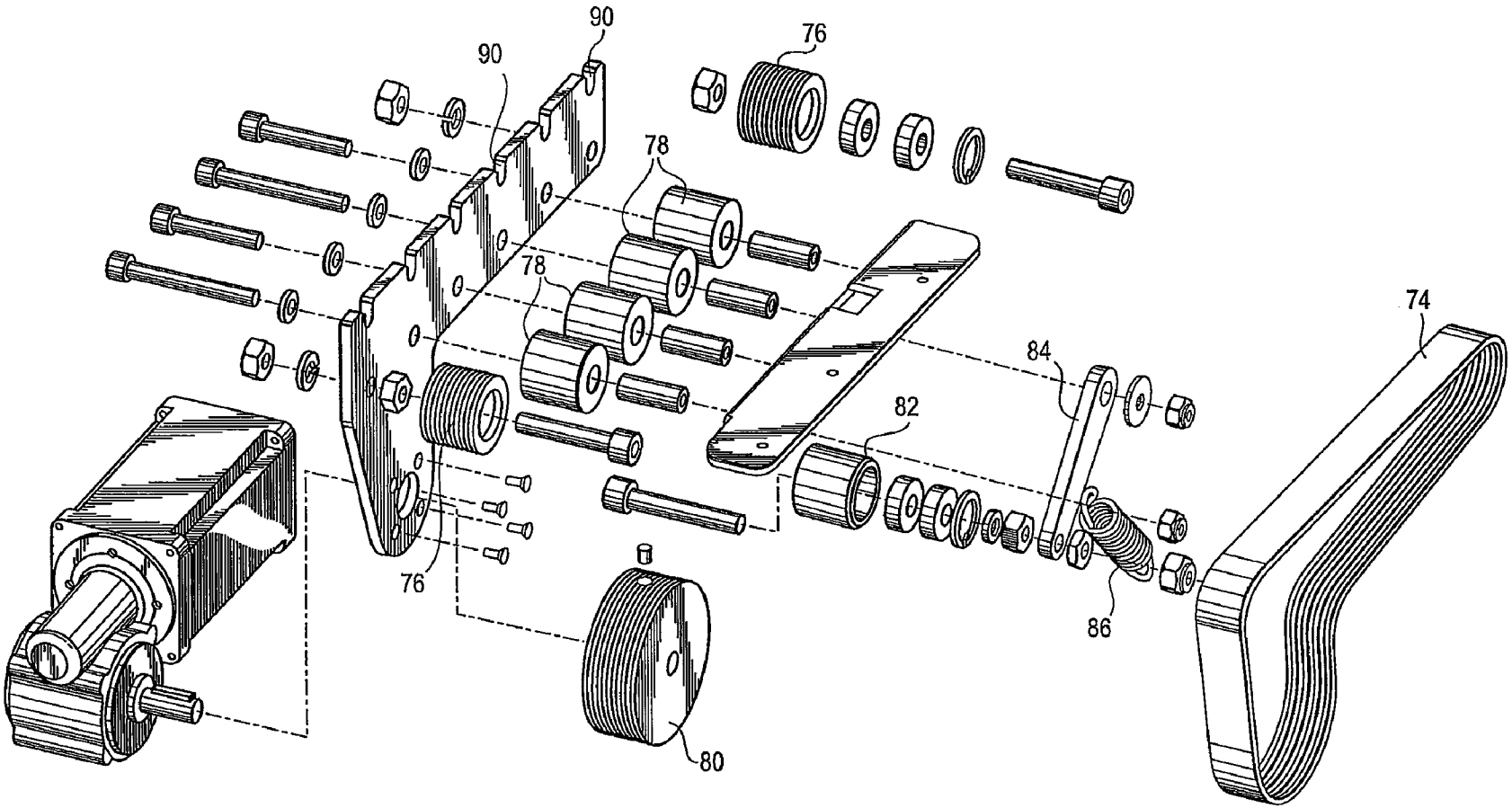
FIG. 7 is an exploded view of the conveyor system again, with the rollers removed for ease of illustration.
Figure 8:
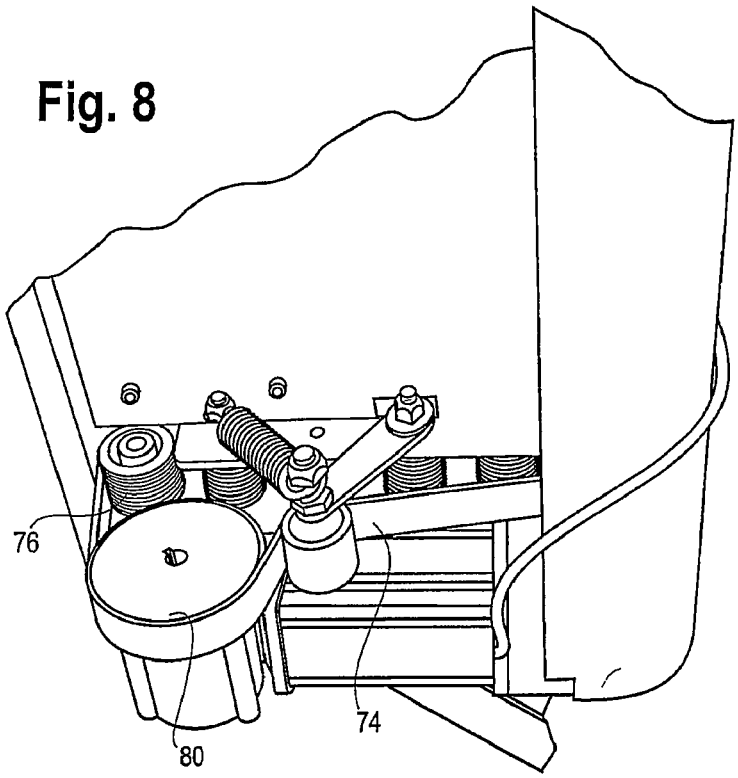
FIG. 8 is a bottom view of the drive assembly for the conveyor system.
Figure 9:
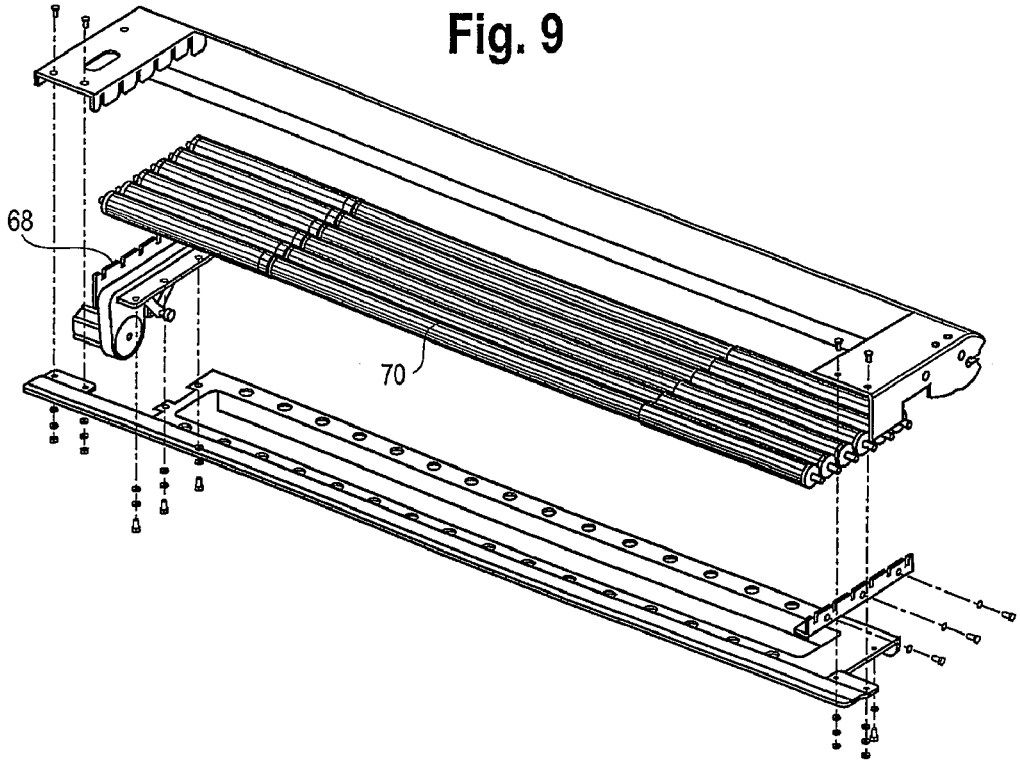
FIG. 9 is an exploded view of the conveyor system, rollers and support elements.
Figure 10:
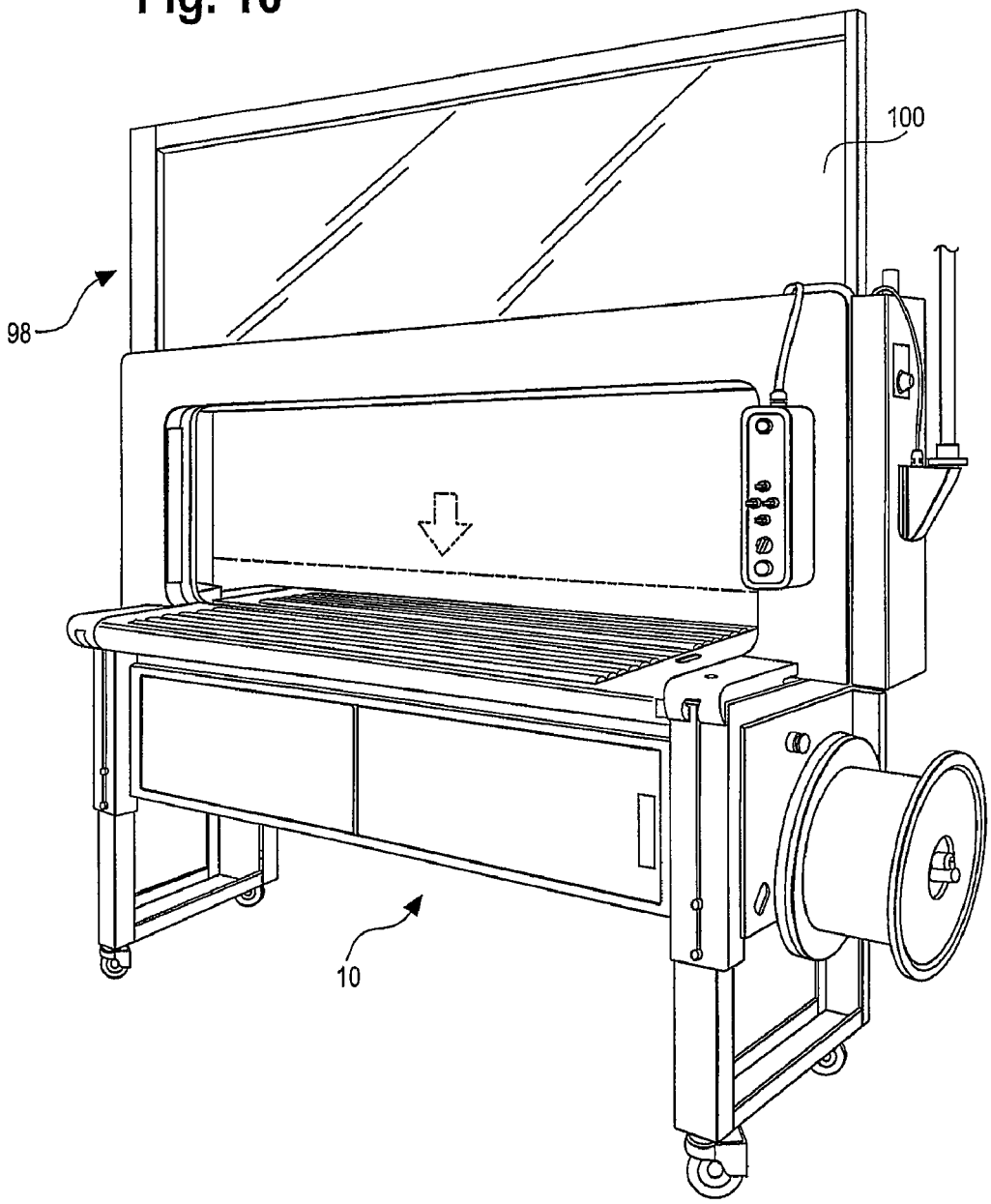
FIG. 10 is a perspective view of the strapping machine illustrating a load compression system of the present invention.
Figure 11:
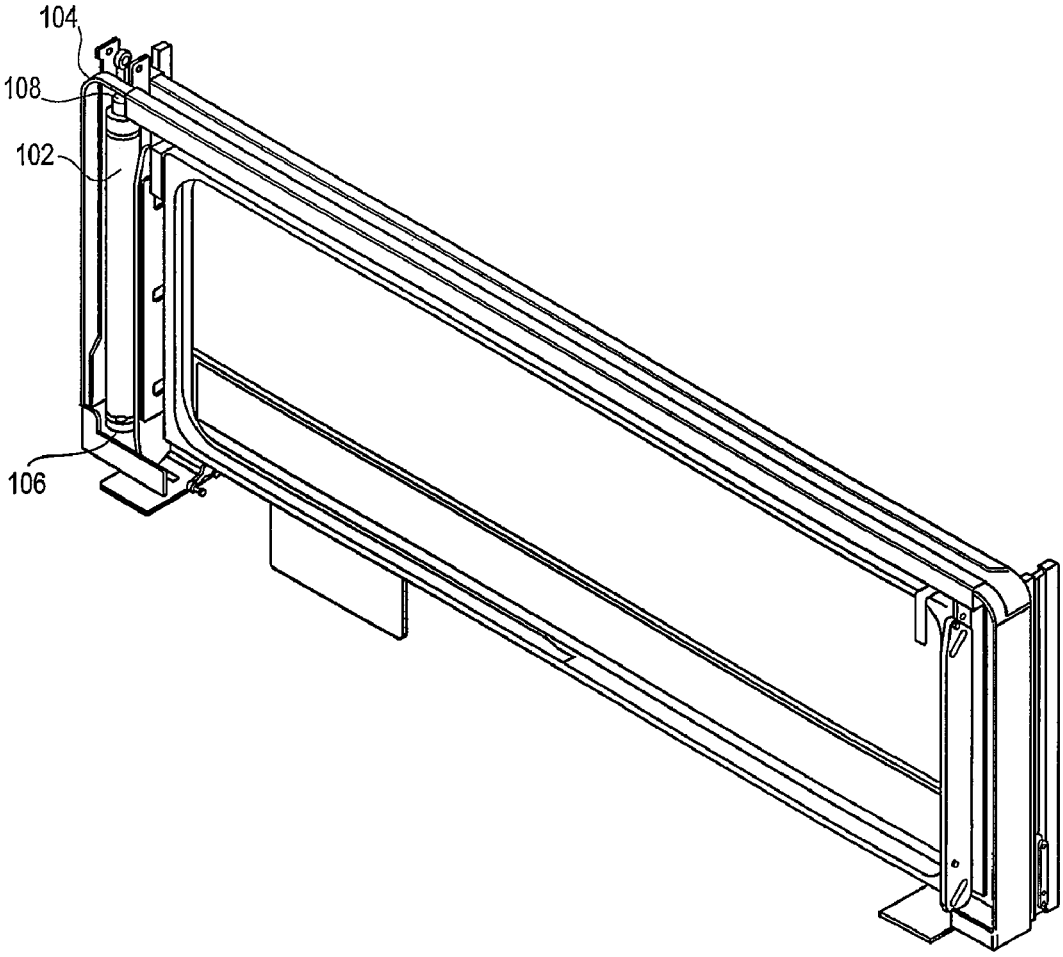
FIG. 11 is a partial perspective view of the load compression system frame and support assembly illustrating the cylinder mounting arrangement.
Figure 12:
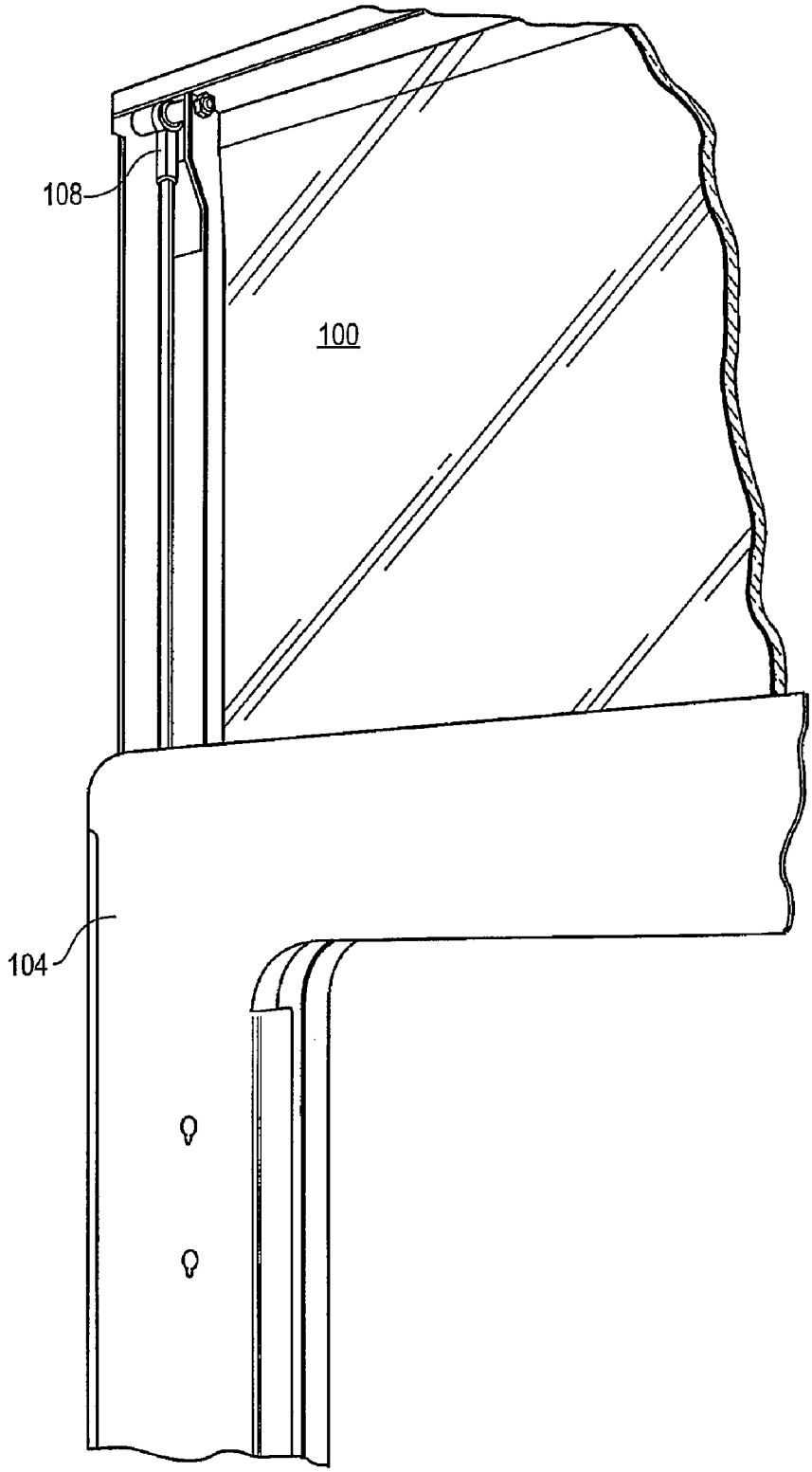
FIG. 12 is a partial view of a corner of the compression screen showing the cylinder mount.
Figure 13:
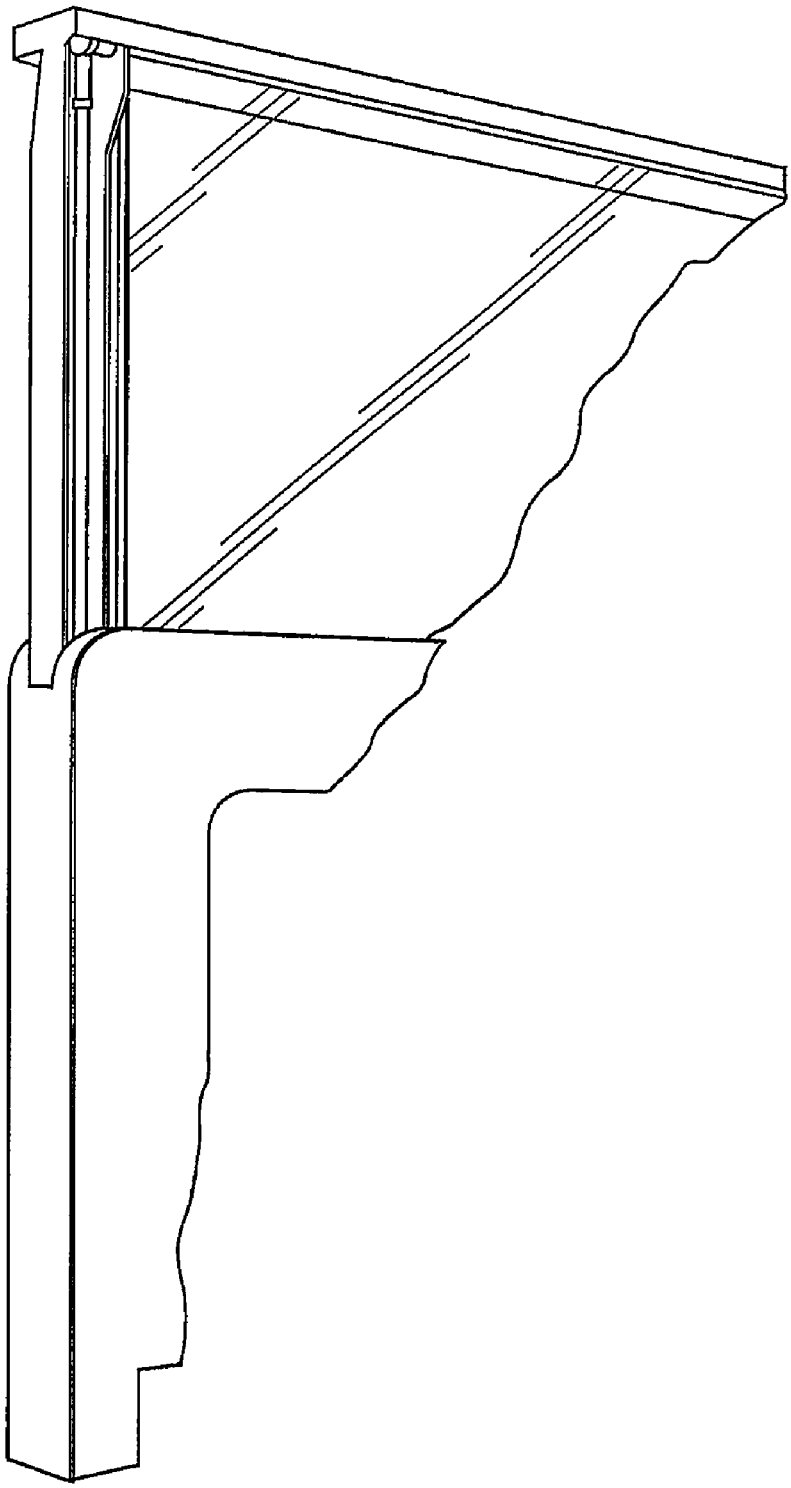
FIG. 13 is a illustrates an outside wall of the compression mount frame.
Figure 14:
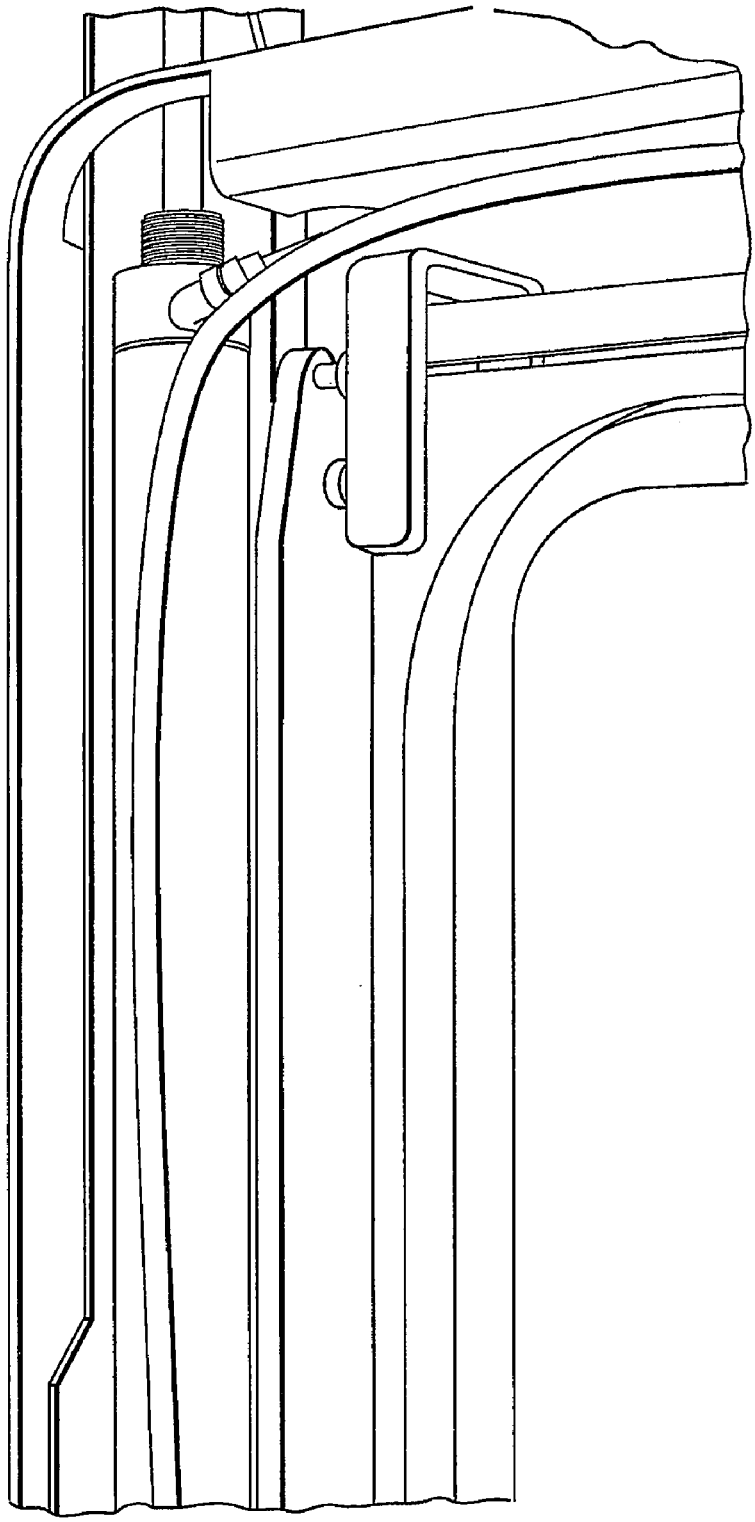
FIG. 14 is an enlarged view of the cylinder mount.
Figure 15:
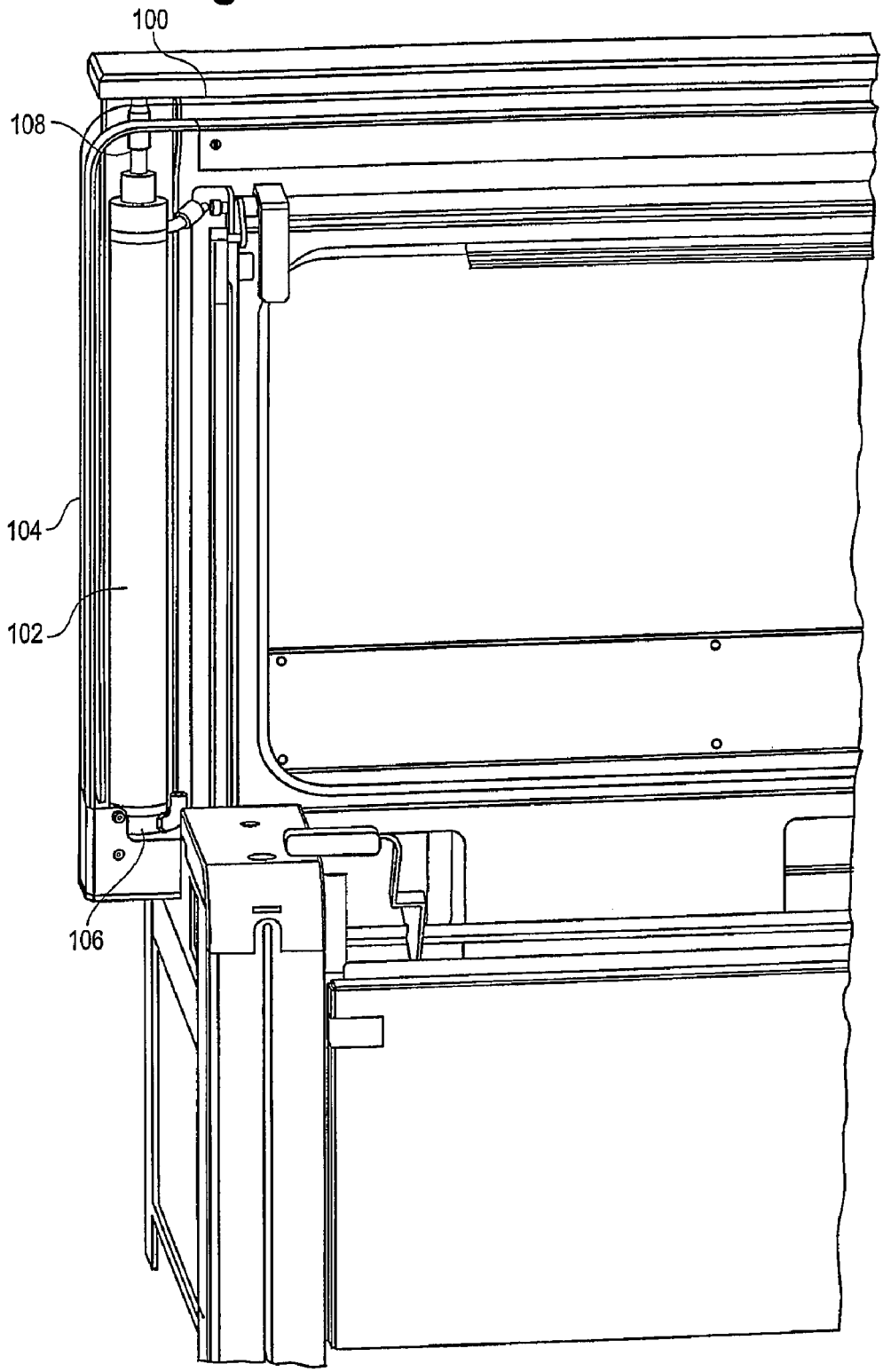
FIG. 15 is a view of the compression mount cylinder in the retracted state.
Figure 16:
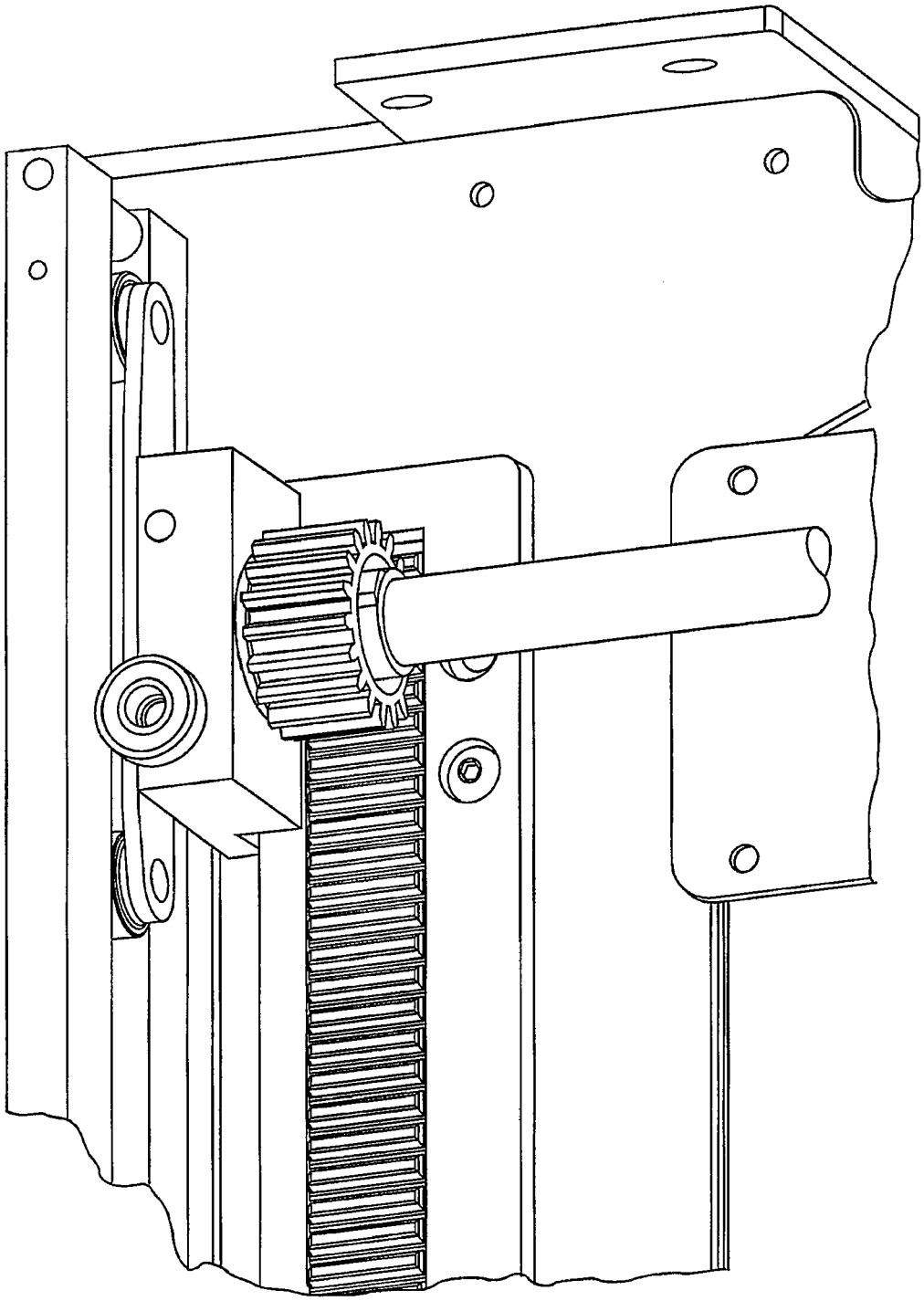
FIG. 16 is an enlarged view of a section of the compression assembly.
Figure 17:
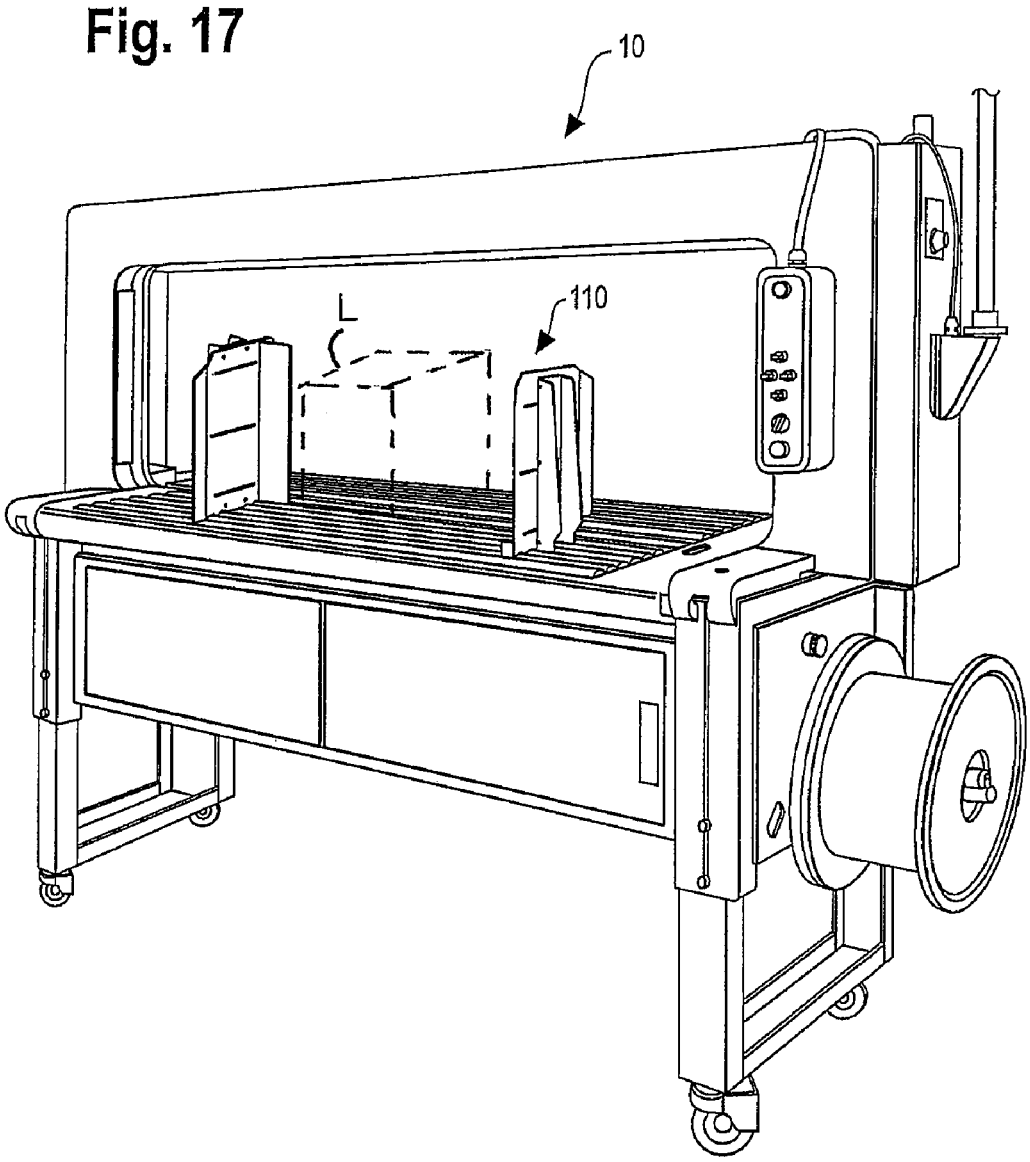
FIG. 17 is a perspective view of the strapping machine illustrating a load side squaring system of the present invention.

The present strapping machine 10 includes a novel work surface lift system 32 to facilitate lifting the conveyors 28, 30 to raise and hold them in an open condition. As seen in FIGS. 2 and 3, the lift system 32 includes an arm 34 that is pivotally mounted to the frame at an arm pivot 36. The arm 34 includes a lever portion 38 that extends from an end 40 of the arm 34, about transverse thereto. The lever portion 38 has a roller 42 mounted at a free end 44 that engages a lip edge 46 of the conveyor 28, 30. The pivot 36 is defined at the juncture 50 of the lever portion 38 (at about the elbow), at which the arm 34 is mounted to the frame 12. A hand grip portion 52 is mounted to an opposite end 54 of the arm 34 (opposite of the lever portion 38) and is used to manually operate the arm 34. The grip 52 (arm) is accessed from a front access door 56 in the access panel 58 of the machine enclosure 60 for ease of use.

The hand grip 52 is pulled toward the front of the machine 10 (toward the operator). The mechanical advantage afforded by the longer travel of the arm 34 facilitates lifting of the work surface 22 (conveyor 28 or 30) by the shorter lever portion 38. A cylinder 62 serves to maintain the arm 34 in the engaged (lifted) position and a spring 64 aids in providing the force to return the surface 22 to the closed condition. When in the open state, the lever roller 42 engages a notch 66 formed in the lip edge 46 of the conveyor 28, 30 to prevent the lever roller 42 from slipping along the lip 46 (to inadvertently close).

A load weight engaging conveyor drive system 68 is illustrated in FIGS. 4-9. The system 68 is configured so that the conveyor rollers 70 are driven as the weight on the rollers 70 (the conveyor section) increases. The drive system 68 includes a motor 72, preferably a direct current (DC) driven motor that drives a drive belt 74. The belt 74 is maintained in a generally planar state (relative to the conveyor 28, 30 and rollers 70) by a pair of end rollers 76 that define a plane $P_{76}$ at about their peripheries and intermediate rollers 78 that are also, at their peripheries, about at the end roller plane $P_{76}$.

The belt 74 encircles the rollers 76, 78 and a drive roller 80 on the motor 72. A tension roller 82 is mounted to a pivoting arm 84 that is biased (by a spring 86) to maintain tension in the belt 74. The motor 72 and the rollers (the end 76 and intermediate 78 rollers) are mounted to a carriage or frame 88 that is mounted to the pivoting work surface 22 (conveyor sections 28, 30) to facilitate maintenance on or removal of the drive system 68.

The frame 88 includes slots 90 in which the conveyor roller ends (spindles 92) reside during operation. The roller spindles 92 "float" in the slots 90 so that the rollers 70 "float" on the drive belt 74. In this manner, the normal force between the rollers 70 and the belt 74 is created by the weight of the rollers 70 combined with the load L on the belt 74. It will be appreciated that the conveyor rollers 70 sit along a top or outer surface 94 of the belt 74 while the end and intermediate rollers 76, 78 (those that are part of the drive 68), sit along a bottom or inner surface 96 of the belt 74. In addition, the location at which the conveyor rollers 70 sit on the belt 74 is between adjacent end/intermediate rollers 76, 78 and, likewise, the end/intermediate rollers 76, 78 support the belt 74 between adjacent conveyor rollers 70. In this manner, the conveyor rollers 70 are in effect cradled by the belt 74 between drive rollers 76, 78.

FIGS. 10-16 illustrates a load compression assembly 98. Load compression is provided by a compression gate 100 that is actuated by a cylinder 102, located on a side of the gate 100. The compression assembly 98 is configured to compress the load L prior to strap S being positioned and tensioned around the load. This reduces the amount of strap that has to be fed out and in turn retracted to strap the load. It also provides a pre-load on the load which in turn reduces the amount of work that has to be done by the feed and strapping (weld) heads 16, 18.

As set forth above, compression gate drive is provided by a rod-type cylinder 102, located on a side of the gate 100. The cylinder 102 is mounted within the chute arch enclosure 104, which is the frame structure that houses the strap chute 14. In this manner, one end 106 of the cylinder 102 is mounted to the frame 12 at about the work surface elevation 22 and the other end 108 (the rod) is mounted to the gate 100. Accordingly, no additional space is required, nor addition structure required to house the gate 100 and cylinder 102 above the topmost extension of the gate 100. Advantageously, this reduces the overall head space required for the compression assembly 98, and when the gate 100 is in the lowered position (e.g., the compression position), the cylinders 102 are fully retracted and thus the overall machine 10 height is less than known machines (that have overhead mounted cylinders).

FIGS. 17-20 illustrate a side squaring system 110 that is configured to square the lateral sides of a load L and to restrain the forward movement of the load (which in effect squares the longitudinal (front) edges of the load. The squaring system 110 includes a pair of opposed laterally moving side squaring plates 112. In the illustrated embodiment, both side plates 112 have forward edge squaring plates 114, however, it will be recognized that the forward squaring plate 114 can be present on only one of the side plates 112 and will function effectively.

The side plates 112 are mounted to a drive system 116 that is mounted to the machine 10 below the rollers 70. In this manner, the drive mechanism 116 does not interfere with the operation of the strapper 10. It will also be appreciated that the side squaring system 110 is mounted upstream (forward) of the strap chute 14, again so that it does not interfere with the operation of the strapper 10.

The drive system 116 is configured to move laterally (sideways) to square the sides of the load L. For example, when strapping magazines, the load can be moved up to the side squaring system 110 and the side plates 112 moved inward so that the leading ends (edges) of the magazines square up to the forward squaring plates 114. The side plates 112 can then move further inward to square up the side edges of the magazines. Once the forward and side edges are squared, the side plates 112 can be retracted and the load can be conveyed forward into the strap chute 14.

Figure 18:
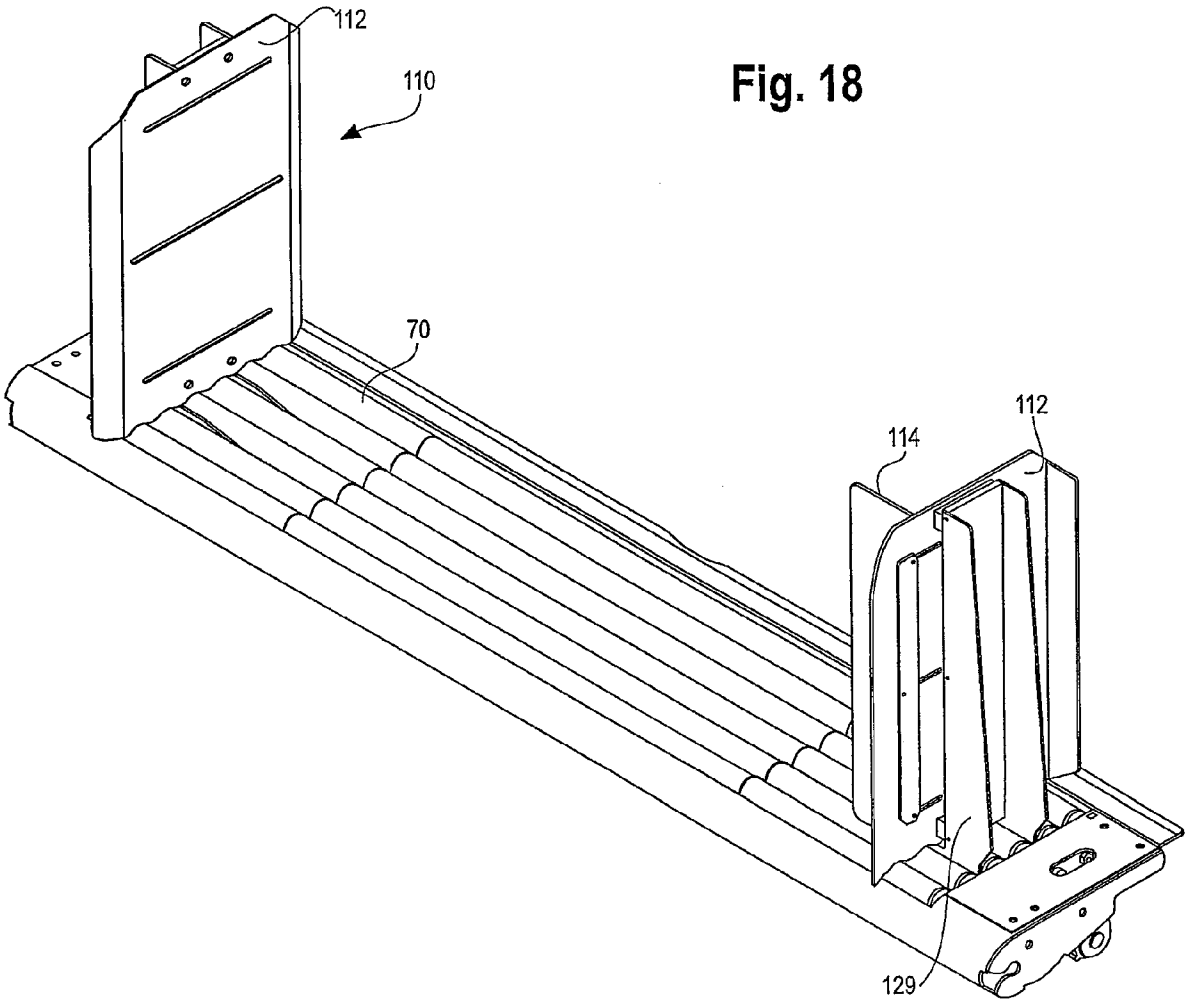
FIG. 18 is a perspective view of the squaring system illustrating the squaring plates and machine rollers.
Figure 19:
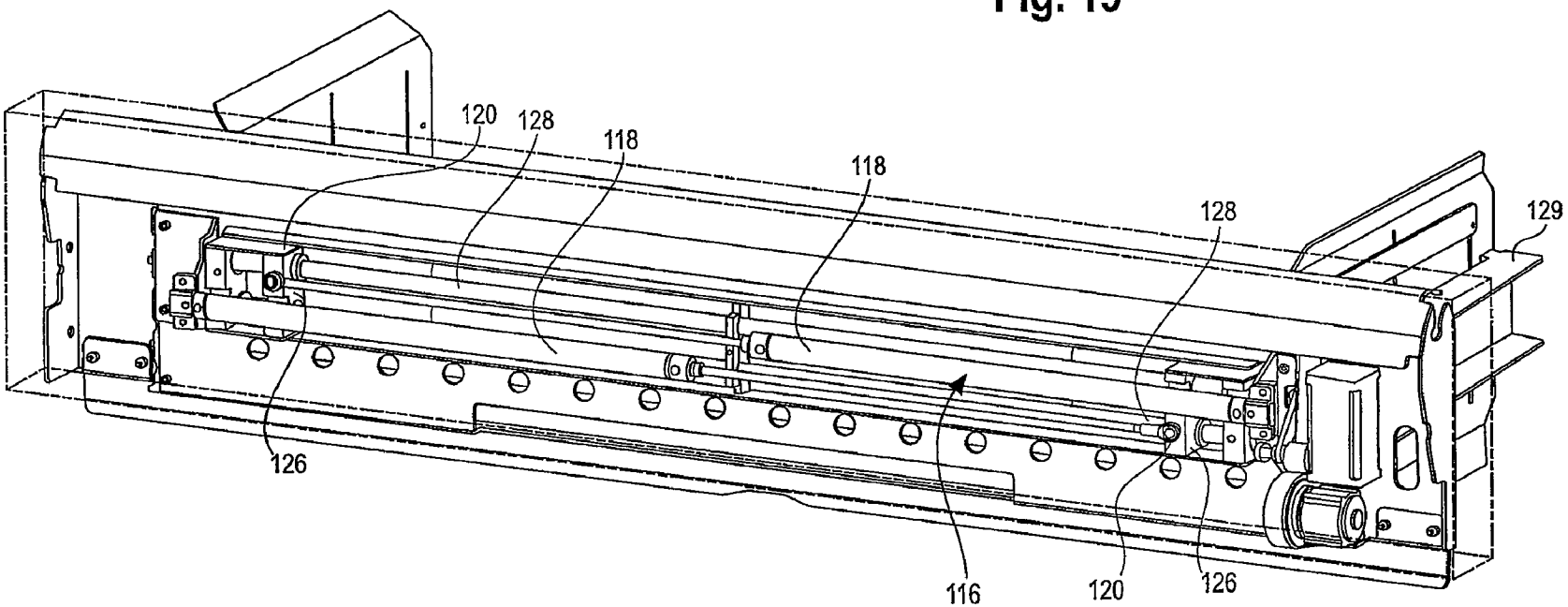
FIG. 19 is a bottom perspective view of the squaring system illustrating the drive system.
Figure 20:
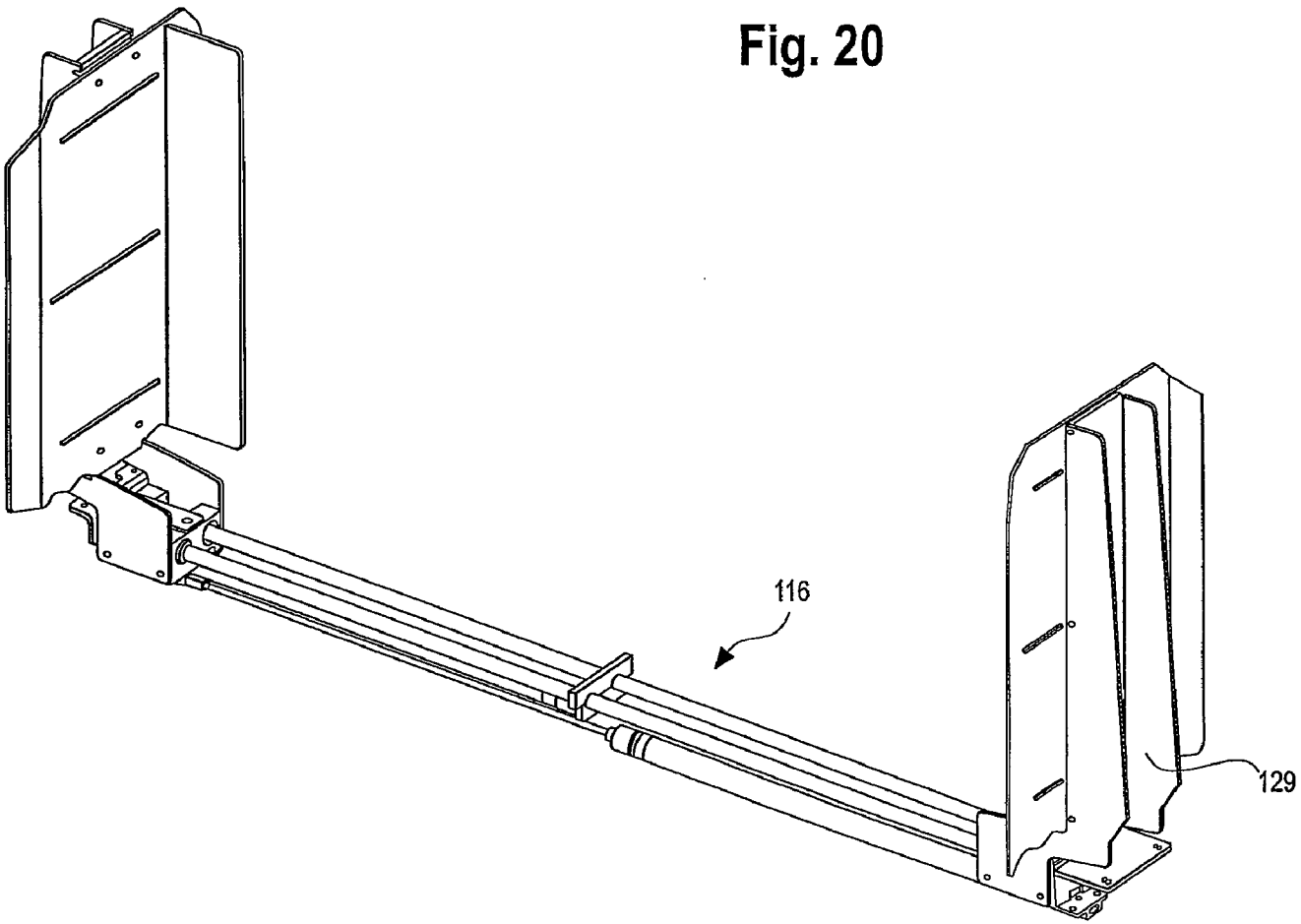
FIG. 20 is a top perspective view of the system with the rollers removed for ease of illustration.

The drive system 116 is configured to move the side plates 112 simultaneously toward and away from each other so that squaring is carried out relatively symmetrically. Accordingly, the drive 116 includes a pair of rod-type cylinders 118 mounted in mirror image relation to one another with the rod ends 120 mounted to the plates 112 (to laterally move the plates 112) and the cylinder ends fixed within the assembly carriage. The rod ends 120 are mounted to bearing plates 126 that traverse along rod bearings 128 to provide smooth movement of the plates 112. As seen in FIGS. 18 and 20, the side plates 112 are mounted to the bearing plates 126 by supports 129 that are positioned and extend up from between rollers 70 so as to prevent any interference.

Figure 21:
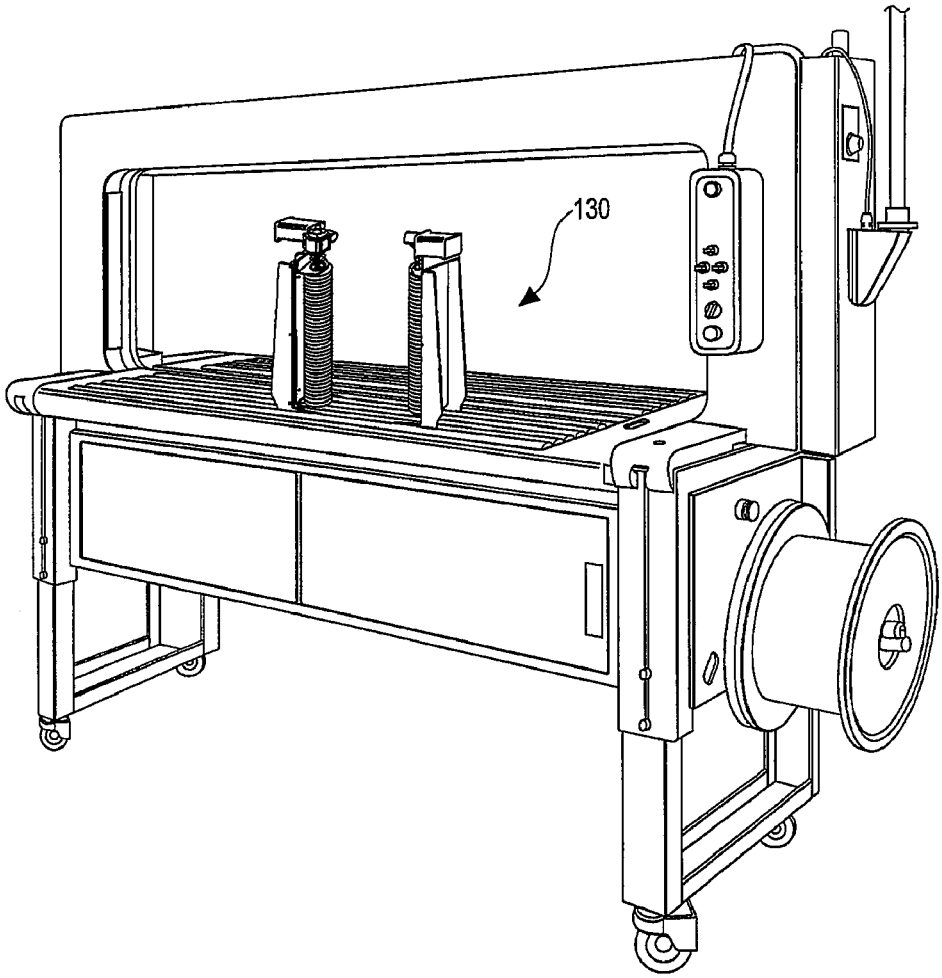
FIG. 21 is a perspective view of the strapping machine illustrating a load stack friction drive system of the present invention.
Figure 22:
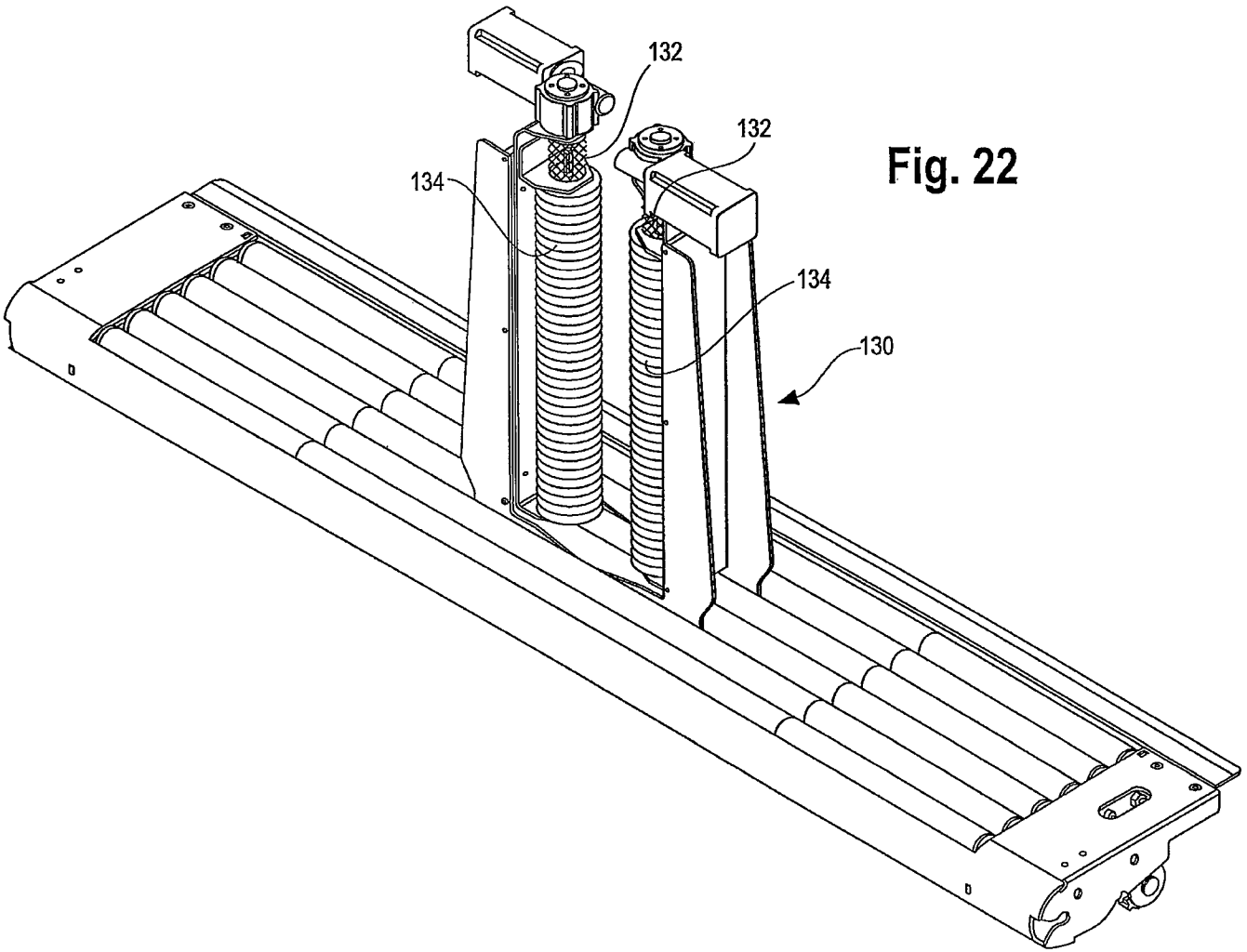
FIG. 22 is a perspective view of the system as it is on the machine rollers.
Figure 23:
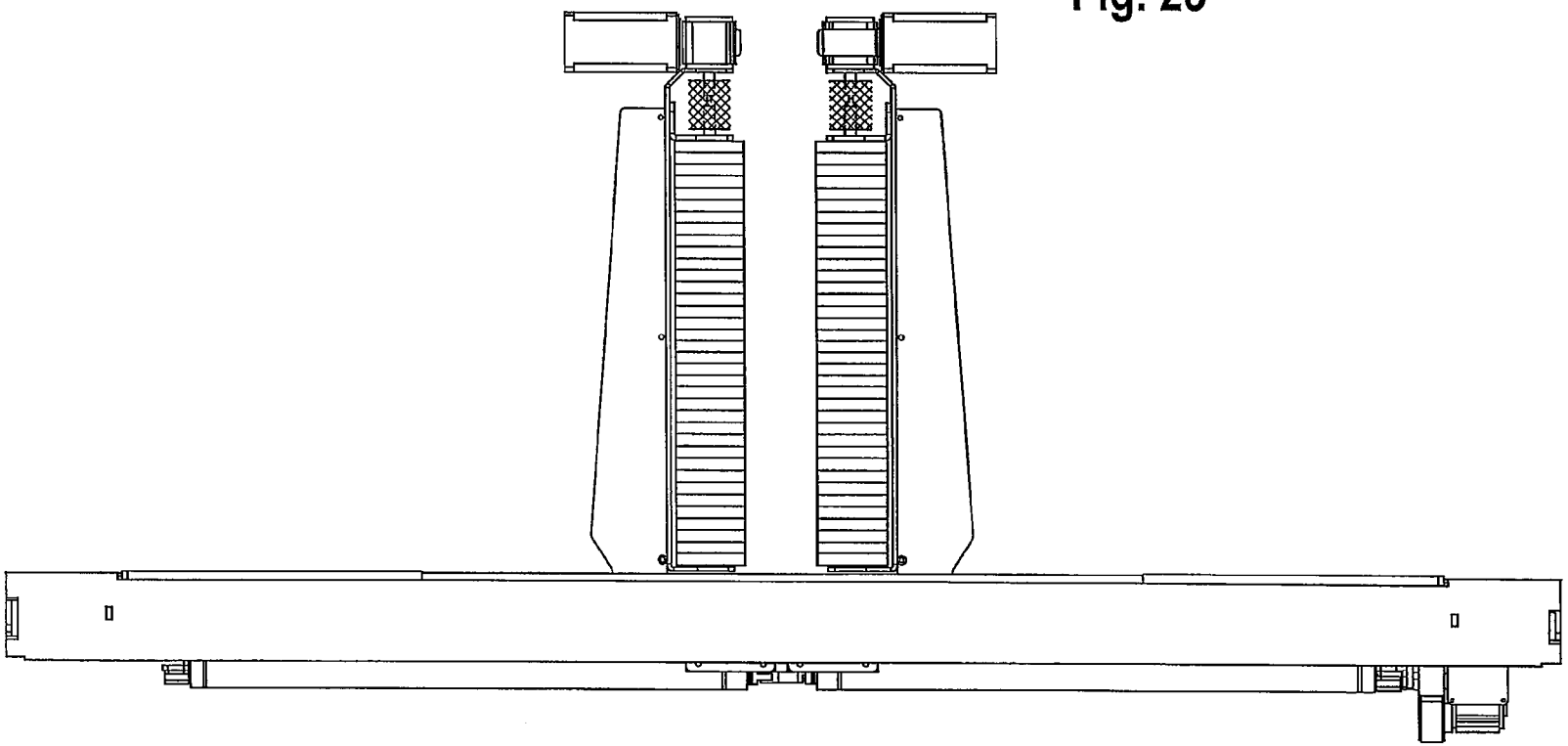
FIG. 23 is a front view of the load stack friction drive system.
Figure 24:
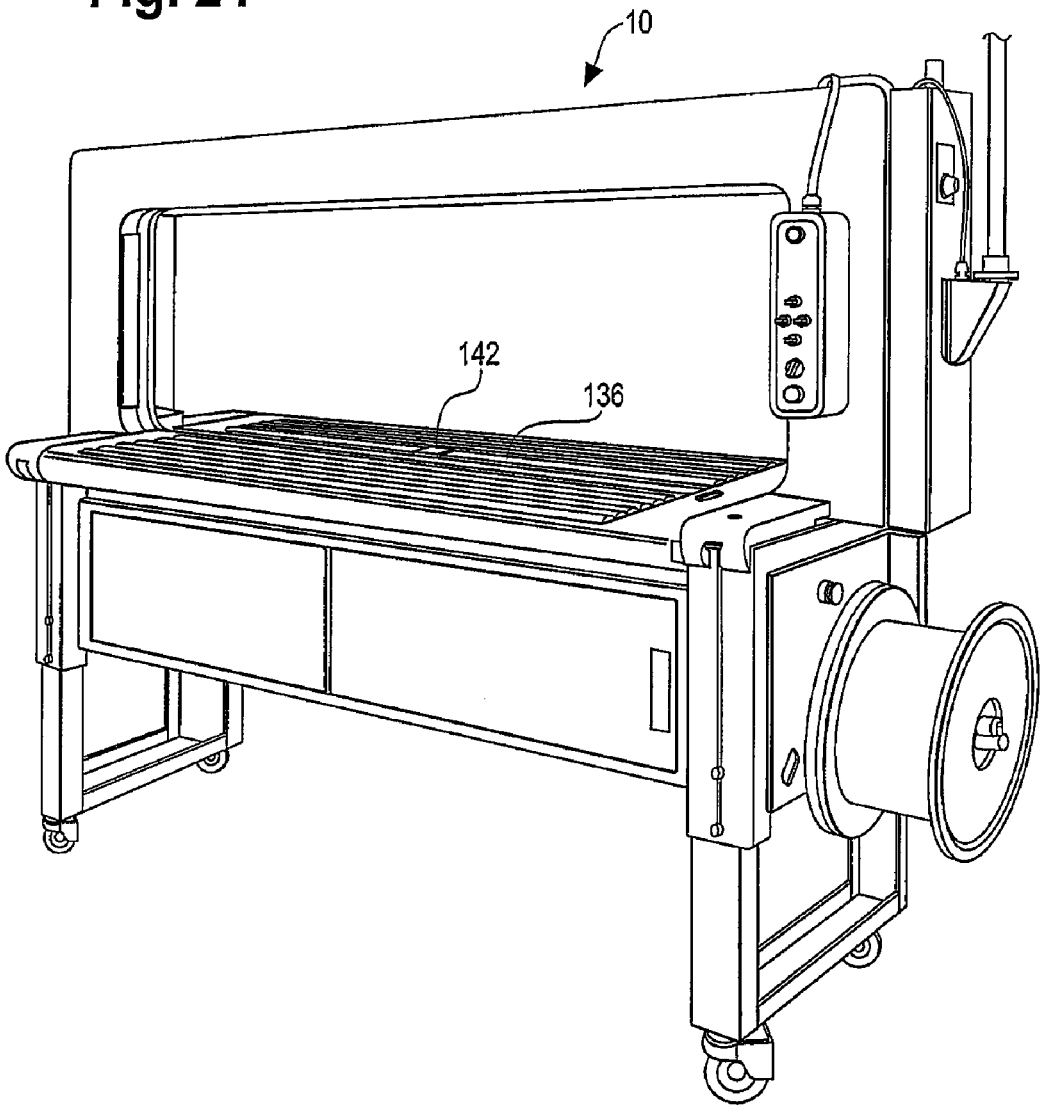
FIG. 24 is a perspective view of the strapping machine illustrating a conveyor nose roller of the present invention.

FIGS. 21-23 illustrate a longitudinal squaring drive 130 that is able to function with the forward edge squaring plates 114 of the forward squaring drive. The longitudinal squaring drive 130 includes a pair of opposing, rotating central elements 132 and a plurality of loosely mounted rotating rings 134. The drive element 132 and rings 134 are formed from a resilient, low friction material, such as neoprene or the like. The rings 134 are loosely mounted or fitted to their respective drive elements 132 so that the rings 134 will rotate when they are in contact with the central drive element 132. However, when the friction or contact force between the rings 134 and the load L or material being driven is too great, the rings 134 will not rotate. Rather the friction between the rings 134 and the load L is too great to permit the rings 134 to move. Accordingly, when, for example, a load of material (such as the exemplary magazines) is introduced to the longitudinal squaring drive 130, the magazines that may be out of longitudinal (forward to rearward) alignment contact the rotating rings 134 and are driven into the forward squaring plates 114 of the forward squaring drive, positioned after the longitudinal squaring drive at the out-feed end of the strapping machine. When, however, the magazines contact the forward squaring plates 114, the friction that results at the rings 134/magazine interface is too great for the rings/drive element 134/132 to overcome, and the rings 134 stop rotating relative to the drive elements 132.

FIGS. 24-28 illustrate a necked-down roller 136. It will be appreciated that the roller or those rollers closest to the strap chute often cannot be full length rollers due to interferences or, as illustrated, plates P that may overlie a portion of the chute at about the strapping head. Because these rollers are not full length (that is, they do not fully extend across the conveyor), they are not driven rollers. Instead, these rollers are idler or passive rollers that only provide a bearing surface across which the package can move. This can be problematic, especially with smaller items or packages that are not sufficiently long to extend from one driven roller (on the infeed side), across the chute area, and on to the next driven roller (on the outfeed side).

The present necked-down roller 136 overcomes these drawbacks by providing a roller having a smaller diameter portion at about the middle of the roller 138 and larger outer sections 140 (that are the same diameter as the other rollers 70) that is driven together with the remaining rollers 70 on the conveyor 28, 30. In this manner, accommodation is made for the interference (plate 142) while still maintaining the roller outer sections 140 at the same diameter so as to properly convey smaller loads into the strapper chute 14 area.

The roller 136 outer roller sections 140 are the same diameter as the other rollers 70 of the conveyor 28. 30. The middle, necked-down transition section 138 bridges the two outer sections 140. A spindle 144 extends through each of the outer roller sections 140 from the end 146 of the outer section 140 to a bearing 148 at the necked-down transition 138. The spindles 144 are held within the roller sections 138, 140 by a plurality of bearings 148, 150, which as illustrated, can include inner and outer bearings on each of the outer sections 140. Accordingly, the outer sections 140 can rotate while the spindles 144 remain fixed with the ends 152 residing within the conveyor drive frame slots 90 (see FIG. 5). The smaller diameter transition section 138 is press-fit to the outer sections 140 so that the entirety of the roller 136 functions as a single element with the stationary spindles 144.

Figure 29:
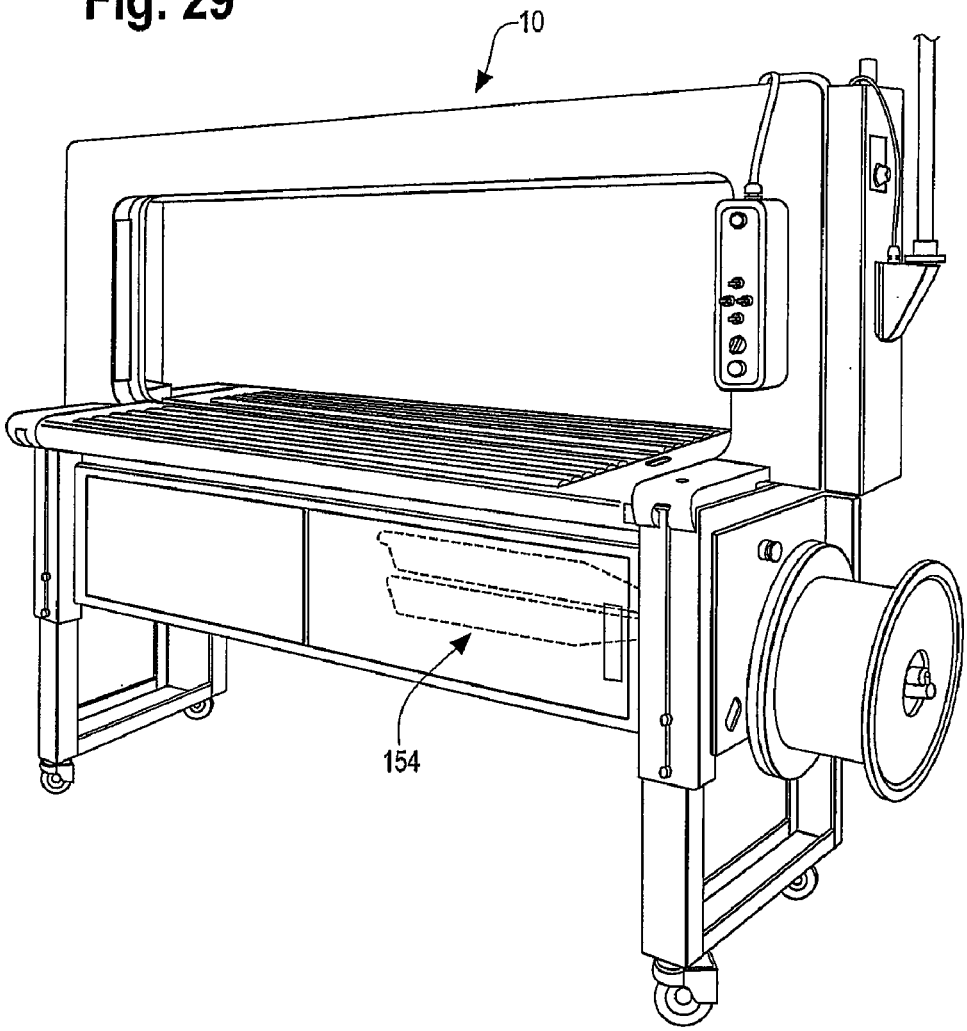
FIG. 29 is a perspective view of the strapping machine illustrating in phantom a strap guide and opening system of the present invention.
Figure 30:
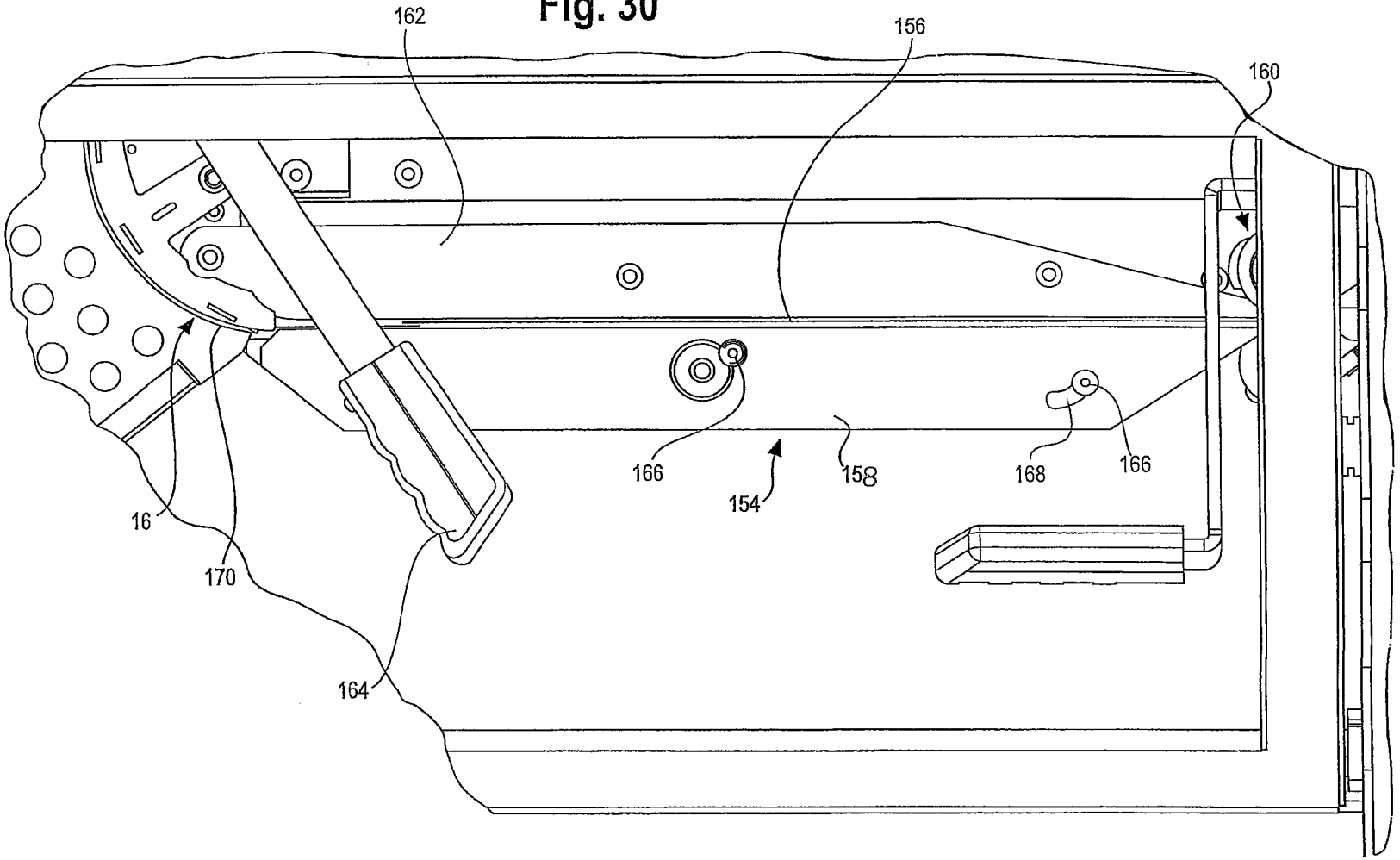
FIG. 30 is a partial view of the strap guide and opening system with the guide in the open state.
Figure 31:
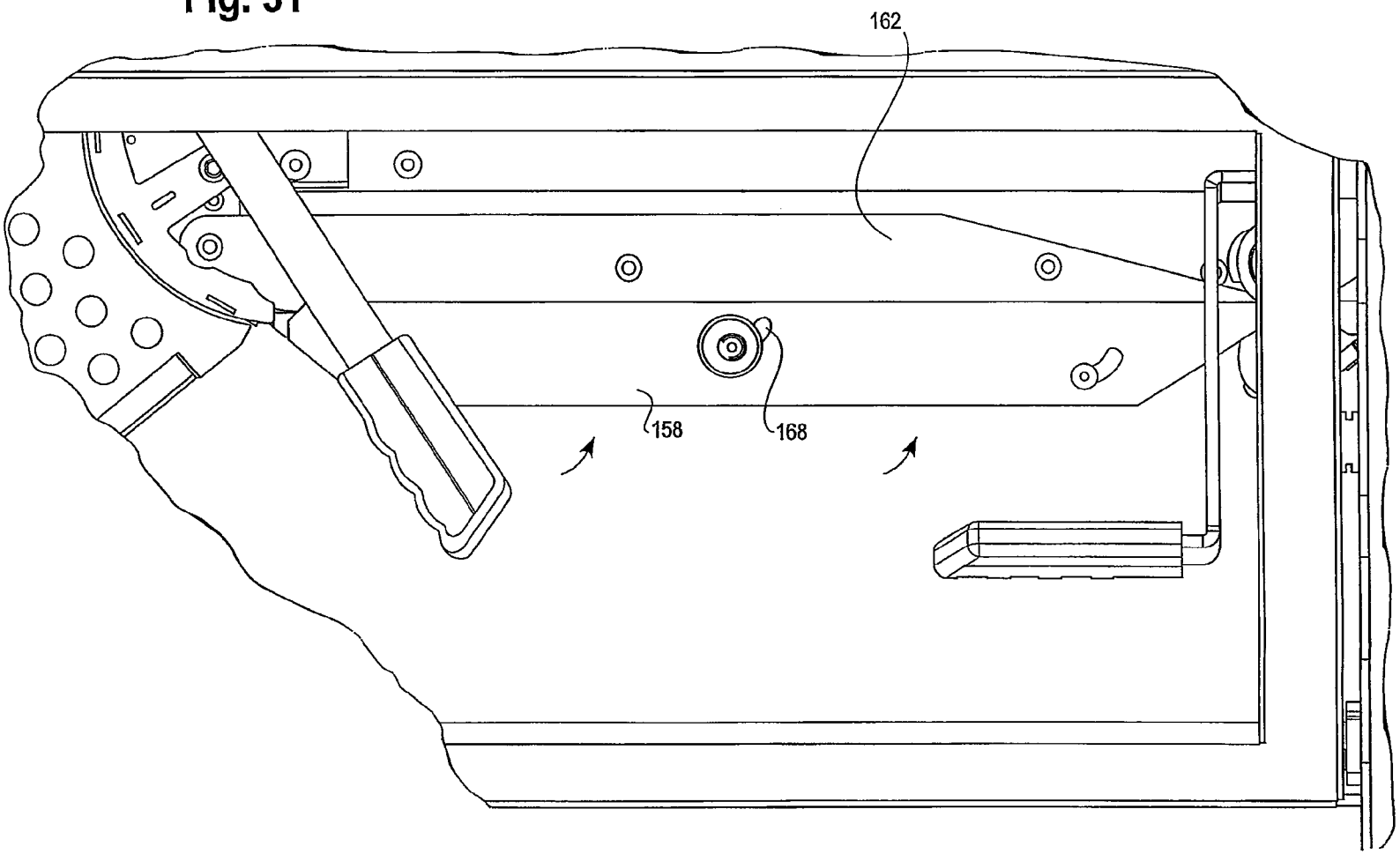
FIG. 31 is a view similar to that of FIG. 30 with the guide in the closed state.

FIGS. 29-31 illustrate a strap guide and opening system 154 that is configured for a machine 10 such as the elevated work surface 22 machine discussed above. The opening strap guide 154 provides a pathway (indicated generally at 156) through the machine 10 from the supply 26 to the strapping head (or the feed system 16) so that the strap S can traverse in a controlled and unobstructed manner. Such a guide 154 is important to prevent the strap from twisting, kinking or otherwise jamming as it is fed from the strap supply 26.

It is also important to be able to access the guide 154 so that strap S can be removed as needed (e.g., sections of jammed strap material). Accordingly, the present strapper guide 154 has a drop down access section 158 that extends from a pre-feed assembly 160 (which is a driven element that is located at the inlet to the machine 10) to the feed head 16. The guide 154 is formed from an upper guide portion 162 that remains stationary and the lower movable guide portion 158. The lower guide portion 158 is actuated (moved) by movement of a handle 164 and moves along a pair of pins 166 that are fixed to the machine 10. The lower guide 158 has arcuate slots 168 along which the guide 158 moves between the open position (FIG. 30) and the closed position (FIG. 31). The arcuate slot 168 shape (as opposed to linear, e.g., vertical shape) provides for lateral movement of the lower guide 158 away from the pre-feed assembly 160 (as the guide 154 is opened) to provide better access in and around the pre-feed 160 area. And in that the strap S is fed about a roller 170 at the feed head 16 (exiting the guide 154), the movement of the lower guide 158 away from the roller 170 at the feed head 16 entrance does not adversely effect strap moving along the strap path 156.

Figure 32:
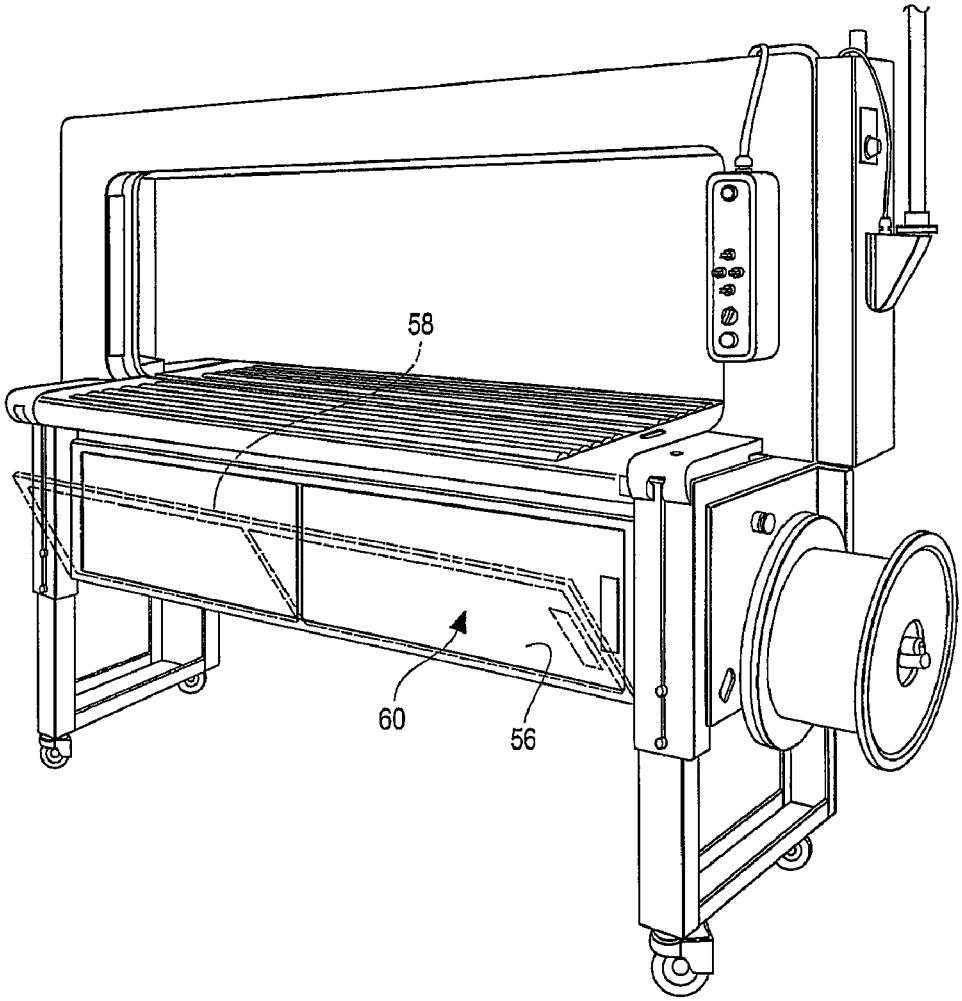
FIG. 32 is a perspective view of the strapping machine illustrating in phantom a drop down front enclosure panel.
Figure 33:
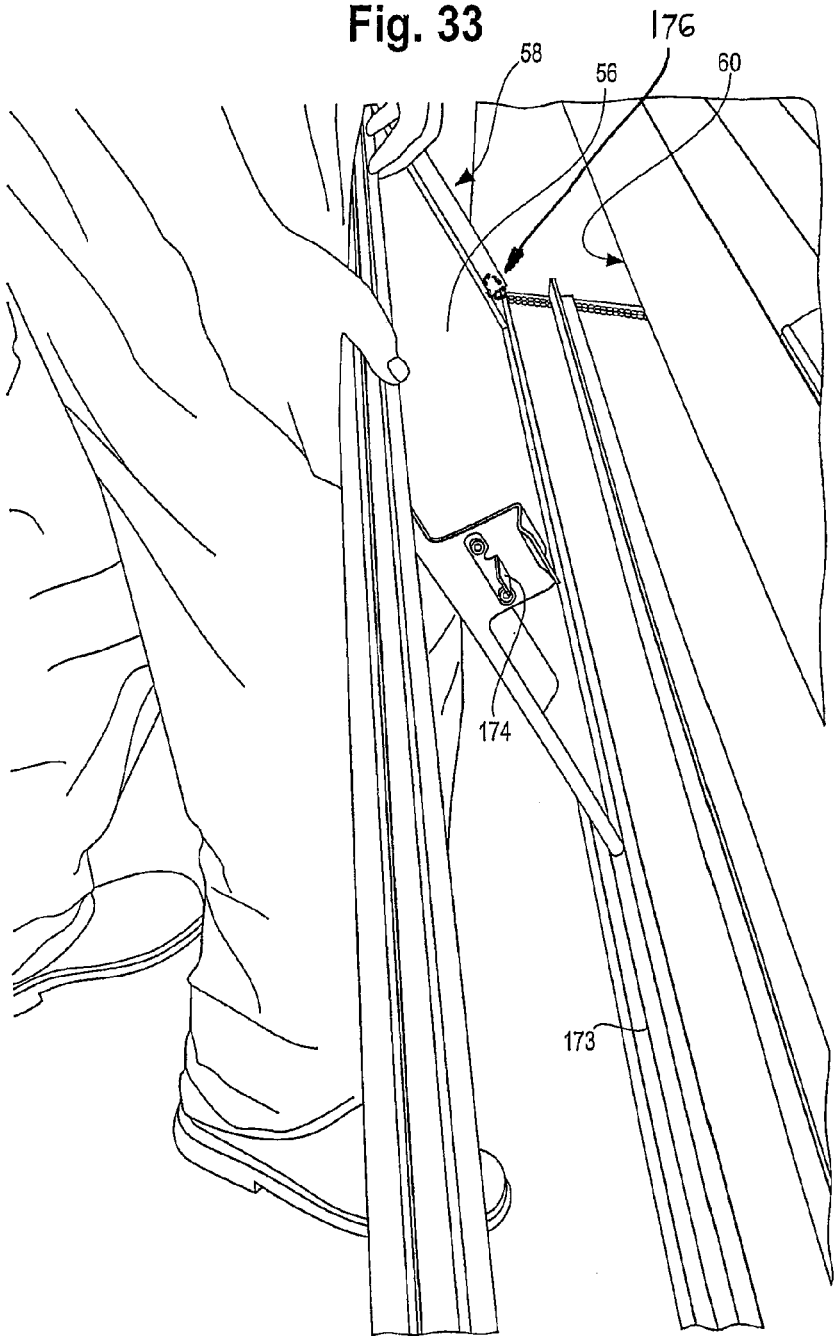
FIG. 33 is a partial view of the drop down panel.
Figure 34:
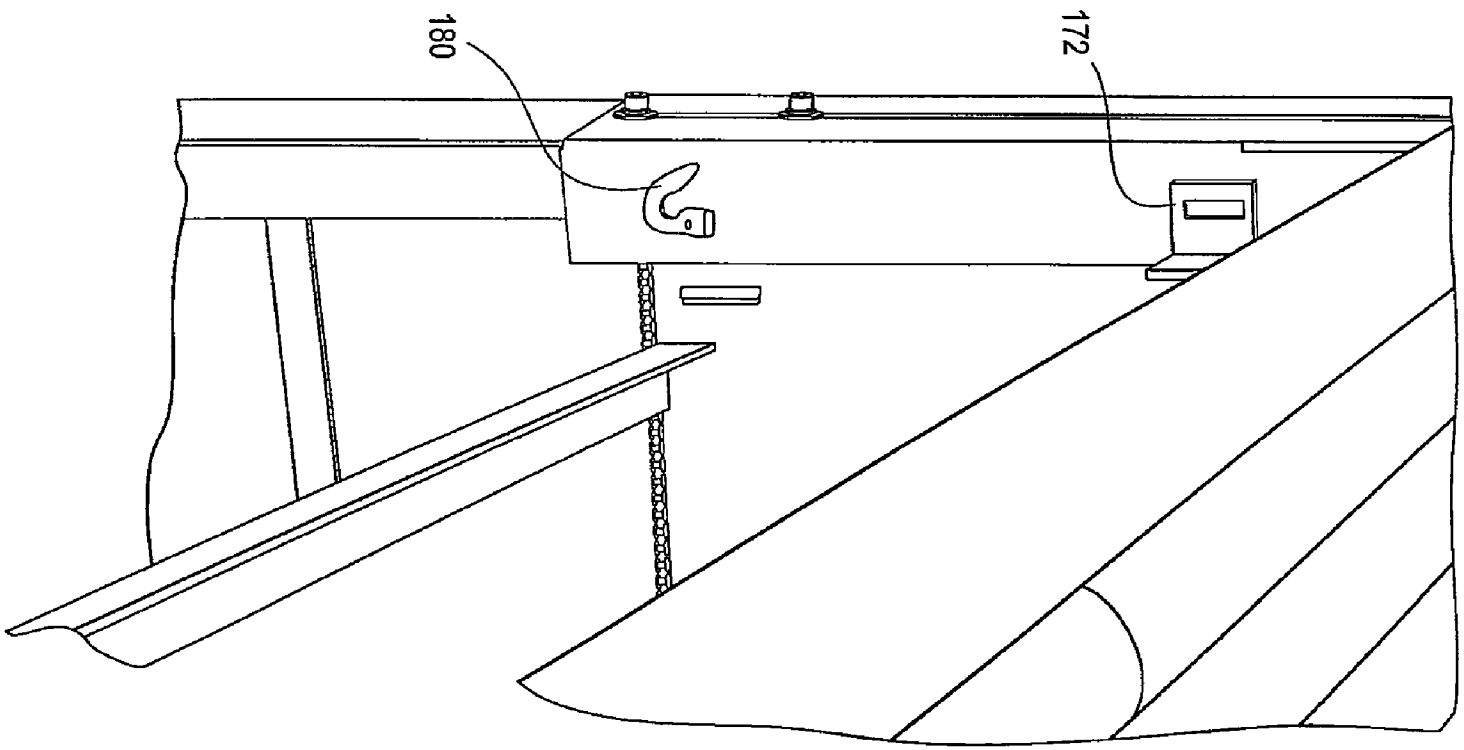
FIG. 34 is a partial view of the frame sides showing the hinges and interlocks.
Figure 35:
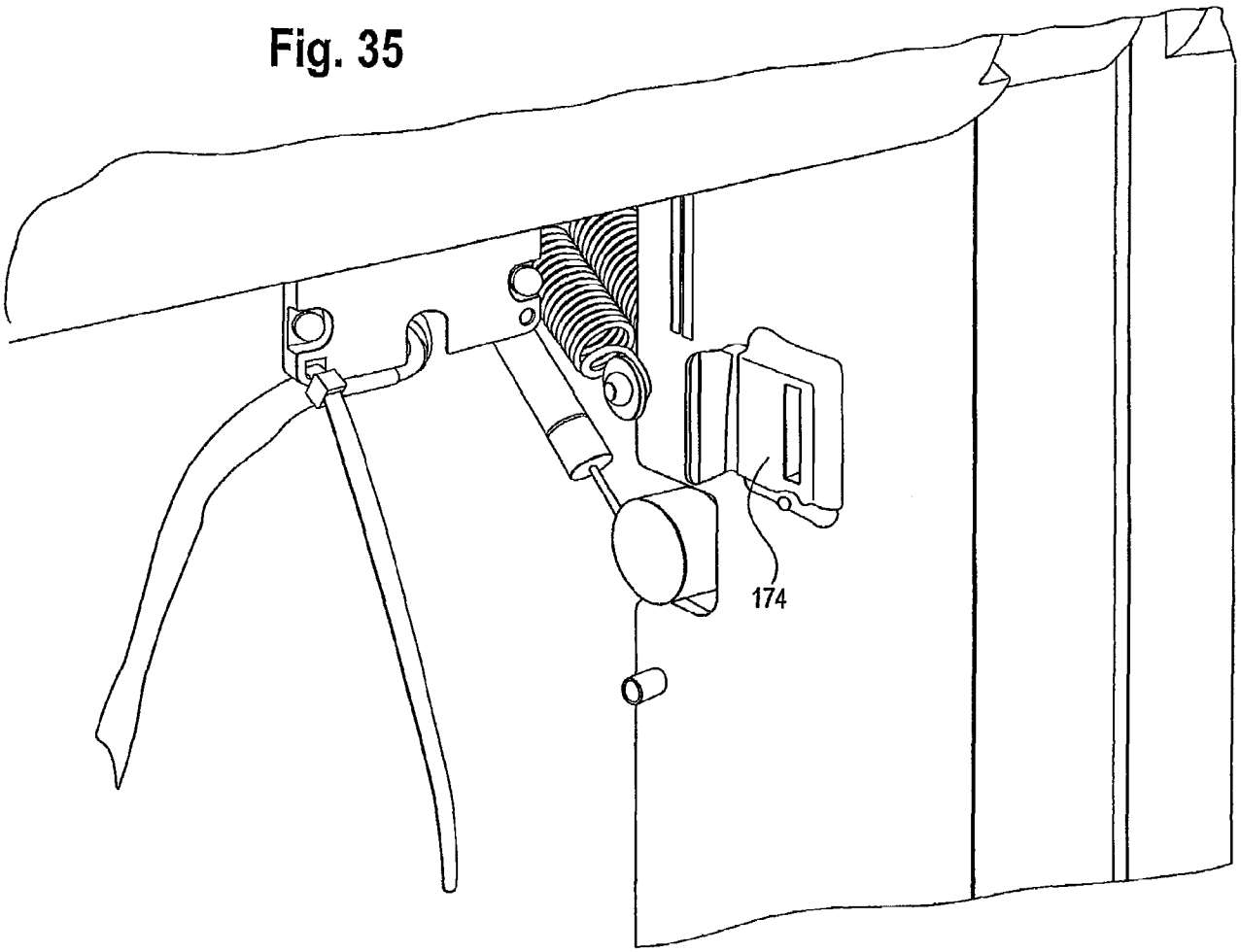
FIG. 35 is another partial view illustrating the panel interlock.
Figure 36:
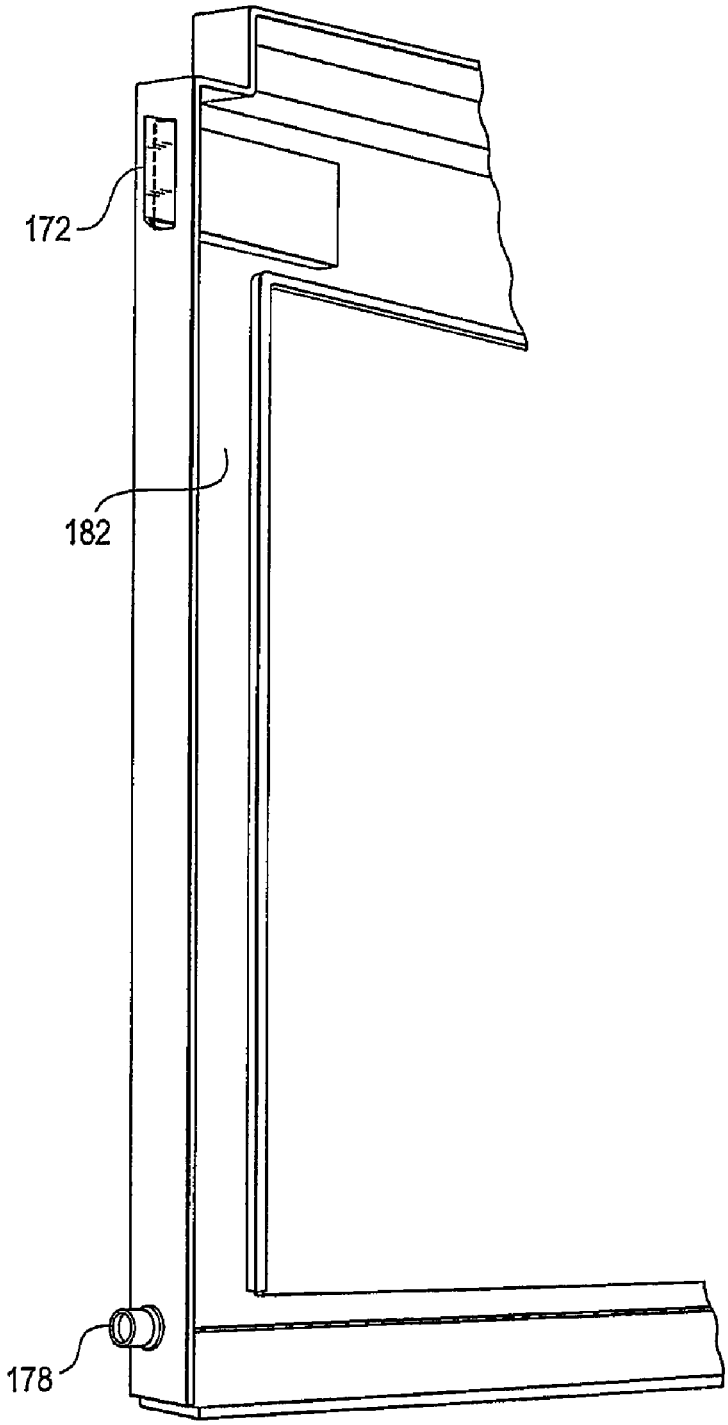
FIG. 36 is a view of the panel side.
Figure 37:
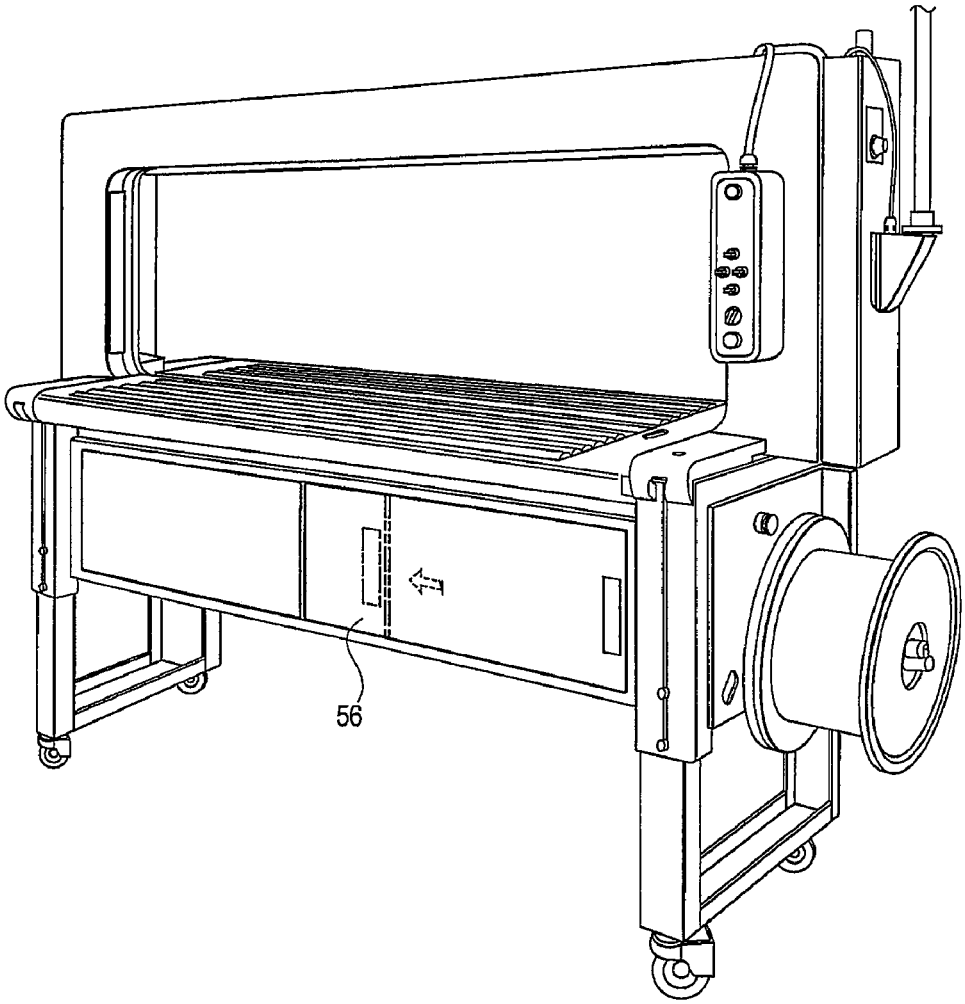
FIG. 37 shows, in phantom, the slide action of the access door within the drop down panel.
Figure 38:
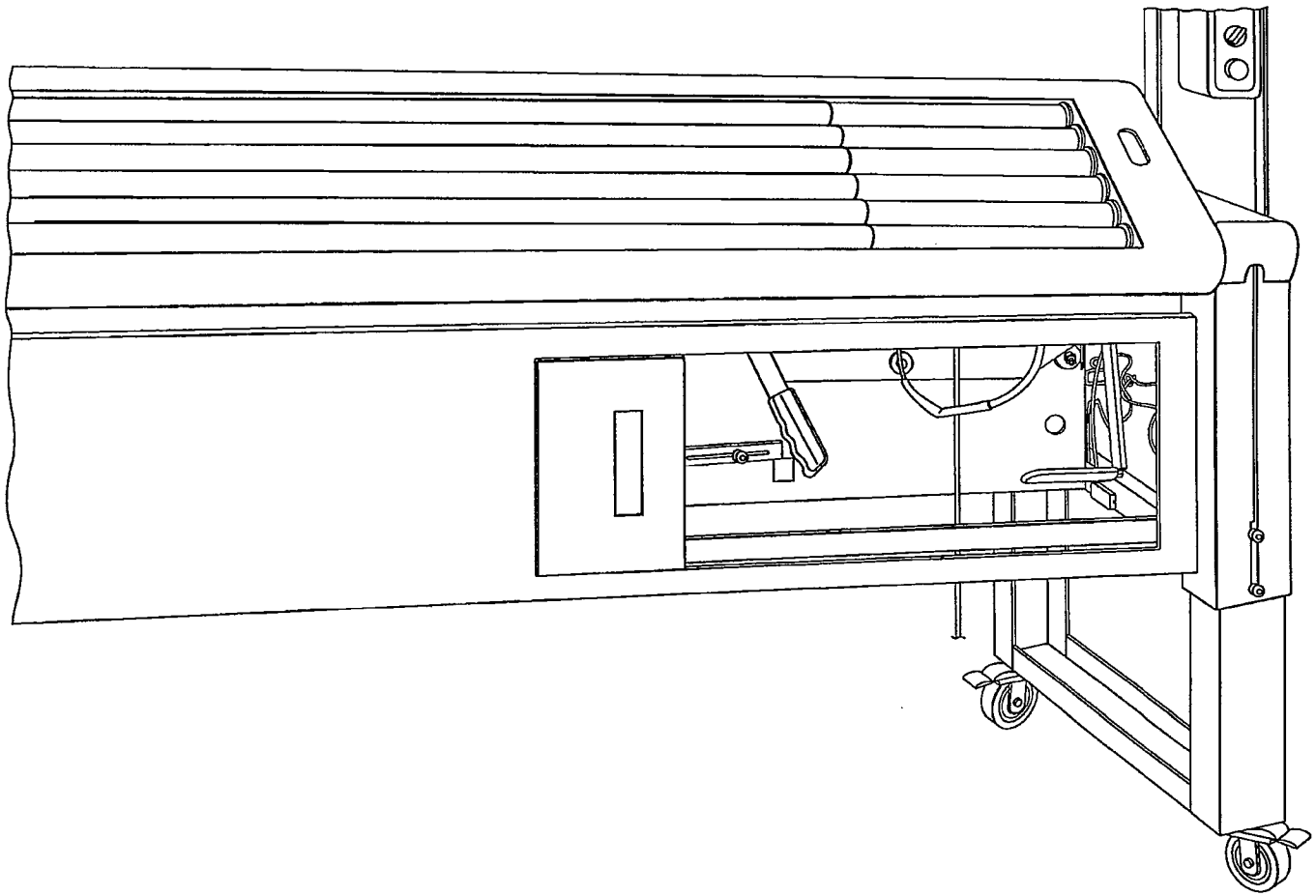
FIG. 38 illustrates the access to and action of the lift arm.
Figure 39:
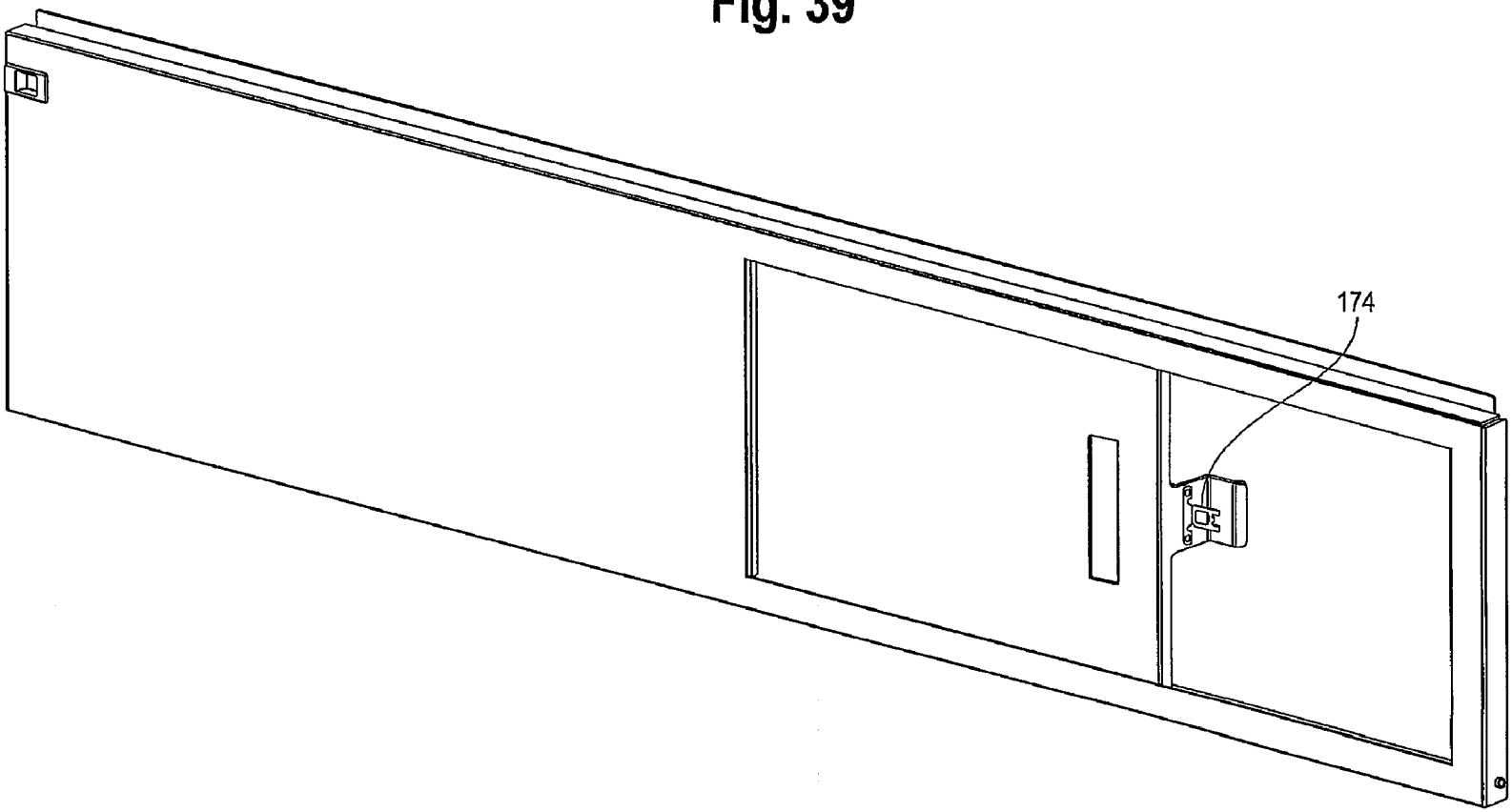
FIG. 39 illustrates the interlock on the access door.
Figure 40:
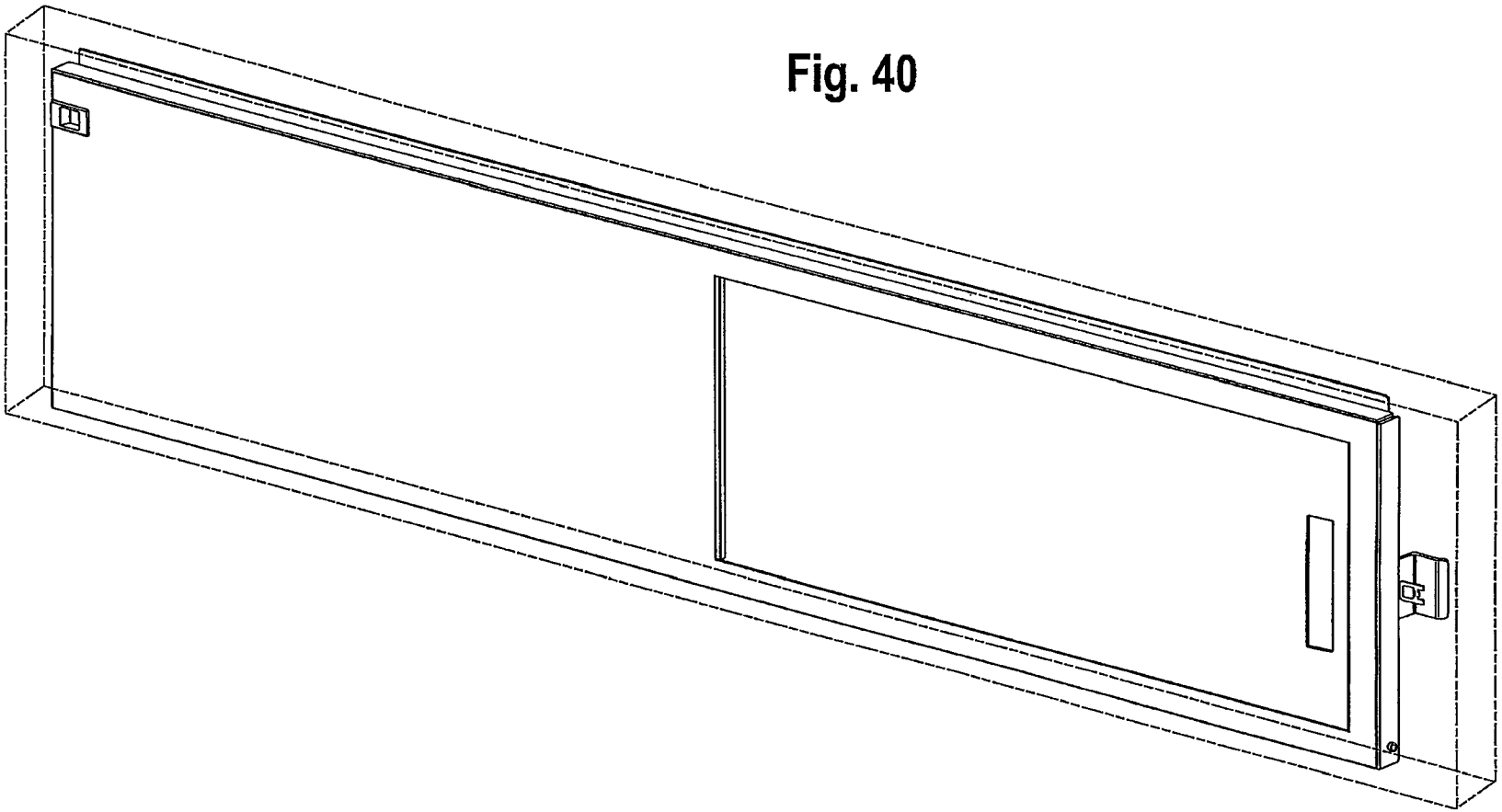
FIG. 40 illustrates the door residing in the drop down panel in phantom.
Figure 41:
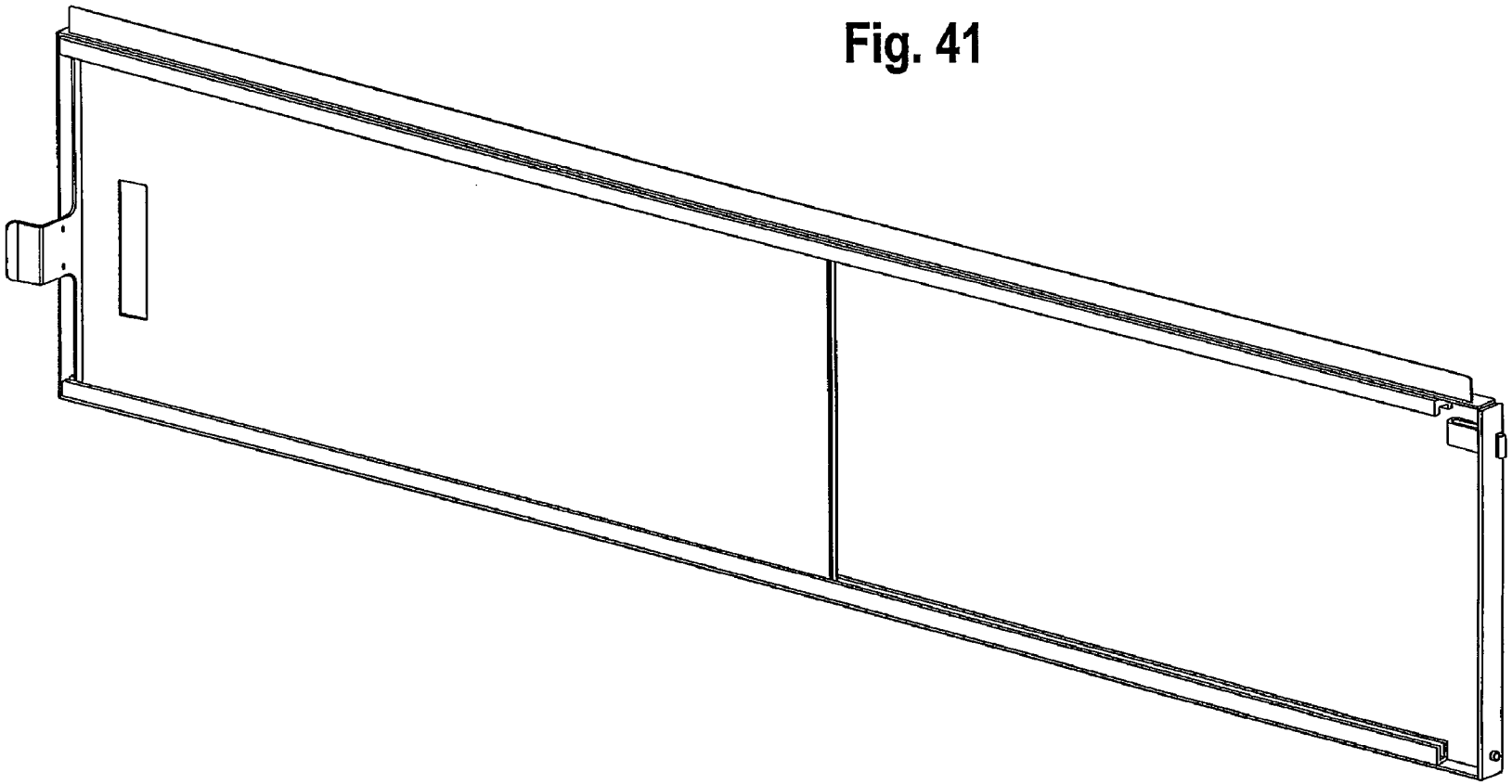
FIG. 41 illustrates the rear of the access door as it resides within the panel.

FIGS. 32-41 are a series of illustrations showing the front enclosure 60, the enclosure access panel 58 and the access panel door 56 and the interlocks 172, 174, respectively, for the panel 58 and door 56. As seen in FIG. 32, the enclosure panel 58 (which includes the door 56) is mounted to the machine frame 12 by hinges 176 to allow the panel to pivot downwardly from the frame 12 to provide complete frontal access to the machine enclosure 60. The panel 58 includes pins 178 that extend outwardly from the lower sides of the panel 58 that are received in hinge sleeves 180 in the frame 12. The panel 58 includes interlocks 172 on the frame 12 (FIG. 34) and the panel 58 (FIG. 36) that isolate power to the machine 10 when the interlock elements 172 are disengaged from one another.

Likewise, the access door 56, which is a two-piece sliding door that slides within a track 173 in the panel 58, also includes interlocks 174 on the door 56 (FIG. 39) and in the door frame 182, which is within the enclosure panel 58 (FIG. 35) that isolate power to the machine 10 when the interlock elements 174 are disengaged from one another. It will be appreciated that both the lift arm 34 and the guide opening handle 164 are accessible from either the open access door 56 or the lowered enclosure panel 58.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A strapping machine configured to feed a strapping material around a load, position, tension and seal the strapping material around the load, the strapping machine comprising:

a machine frame;

a work surface for supporting the load in the strapping machine, the work surface including a conveyor having a plurality of conveyor rollers for moving the load in a load direction into and out of the machine for strapping the load;

a strap chute for carrying the strapping material around the load and for releasing the strapping material from the strap chute;

a feed assembly configured to convey the strapping material around the strap chute in a feed mode and to retract and tension the strapping material around the load during a tensioning mode;

a sealing head for sealing the strapping material onto itself;

a side squaring assembly for aligning the load in the direction transverse to the load direction, the side squaring assembly including a pair of side plates configured to move transverse to the load direction, wherein at least one of the side plates includes a forward squaring plate mounted to the side plate transverse to the side plate, the side squaring assembly disposed along the work surface and upstream of the strap chute, the side squaring assembly including a drive disposed below the work surface to substantially simultaneously move the side plates toward one another; and a longitudinal squaring drive having a pair of rotating engaging elements for squaring the load in a longitudinal direction, the rotating engaging elements include load contact elements mounted to the rotating engaging elements, wherein the load contact elements are rings loosely fitted on the engaging elements.

2. The strapping machine in accordance with claim 1 wherein the drive includes at least one cylinder.

3. The strapping machine in accordance with claim 2 wherein the drive includes a pair of substantially mirror image cylinders.

4. The strapping machine in accordance with claim 3 wherein the cylinders are pneumatic cylinders.

5. A strapping machine configured to feed a strapping material around a load, position, tension and seal the strapping material around the load, the strapping machine comprising:

a machine frame;

a work surface for supporting the load in the strapping machine, the work surface including a conveyor having a plurality of conveyor rollers for moving the load in a load direction into and out of the machine for strapping the load;

a strap chute for carrying the strapping material around the load and for releasing the strapping material from the strap chute;

a feed assembly configured to convey the strapping material around the strap chute in a feed mode and to retract and tension the strapping material around the load during a tensioning mode;

a sealing head for sealing the strapping material onto itself;

a side squaring assembly for aligning the load in the direction transverse to the load direction, the side squaring assembly including a pair of side plates configured to move transverse to the load direction, the side squaring assembly disposed along the work surface and upstream of the strap chute, the side squaring assembly including a drive disposed below the work surface to substantially simultaneously move the side plates toward one another; and a longitudinal squaring drive having a pair of rotating engaging elements for squaring the load in a longitudinal direction, wherein the rotating engaging elements include load contact elements mounted to the rotating engaging elements such that the load is driven forward by the contact elements when there is low resistance to movement and when the load resists movement the contact elements stop and the rotating engaging elements rotate freely of the stopped contact elements wherein the load contact elements are rings loosely fitted on the engaging elements.

* * * * *